US007654883B2

(12) United States Patent
Kitahashi et al.

(10) Patent No.: US 7,654,883 B2
(45) Date of Patent: Feb. 2, 2010

(54) POLISHING APPARATUS, POLISHING HEAD AND POLISHING METHOD

(75) Inventors: Masamitsu Kitahashi, Omura (JP); Toshiyuki Kamei, Omura (JP); Hidetoshi Takeda, Omura (JP); Hiroyuki Tokunaga, Omura (JP); Tamoaki Tajiri, Omura (JP)

(73) Assignee: Sumco Techxiv Corporation, Nagasaki (JP)

( * ) Notice: Subject to any disclaimer, the term of this patent is extended or adjusted under 35 U.S.C. 154(b) by 0 days.

(21) Appl. No.: 12/371,320

(22) Filed: Feb. 13, 2009

(65) Prior Publication Data

US 2009/0156101 A1 Jun. 18, 2009

Related U.S. Application Data

(62) Division of application No. 10/528,287, filed as application No. PCT/JP03/12323 on Sep. 26, 2003, now Pat. No. 7,507,148.

(30) Foreign Application Priority Data

Sep. 27, 2002 (JP) ..... 2002-282549

(51) Int. Cl.
*B24B 1/00* (2006.01)

(52) U.S. Cl. ..... 451/41; 451/286; 451/287

(58) Field of Classification Search ..... 451/41, 451/285–290

See application file for complete search history.

(56) References Cited

U.S. PATENT DOCUMENTS 3,082,013 A 3/1963 Thielenhaus
5,643,061 A 7/1997 Jackson et al.
5,795,215 A * 8/1998 Guthrie et al. ..... 451/286
5,993,302 A 11/1999 Chen et al.
6,110,012 A 8/2000 Maury et al.
6,126,517 A 10/2000 Tolles et al.

(Continued)

FOREIGN PATENT DOCUMENTS

CN 1078836 10/1998

(Continued)

OTHER PUBLICATIONS

International Search Report for related PCT/JP03/12323.

(Continued)

*Primary Examiner*—Maurina Rachuba
(74) *Attorney, Agent, or Firm*—Husch Blackwell Sanders LLP Welsh & Katz

(57) ABSTRACT

A polishing apparatus comprises a polishing plate (24), an abrasive cloth (25) attached to the surface of the polishing plate (24), a chuck (19) for holding and pressing one surface of a wafer (39) against the abrasive cloth (25), and a circular retaining ring (23) concentrically arranged on the periphery of the chuck (19). The retaining ring (23) is rotatable and vertically movable with respect to the chuck (19), and is pressed against the abrasive cloth (25) during the lapping step. The retaining ring (23) is lifted upward during the final polishing step, thereby preventing lapping grains from being brought into the final polishing stage. Accordingly, lapping and final polishing can be successively conducted using the same polishing head. With this structure, cost cutting of the apparatus can be realized, since lapping and final polishing are successively conducted using the same polishing head without bringing the lapping grains used for lapping into the final polishing stage.

3 Claims, 13 Drawing Sheets

U.S. PATENT DOCUMENTS

| | | | | |
|---|---|---|---|---|
| 6,168,684 | B1 | 1/2001 | Mitsuhashi et al. | |
| 6,224,712 | B1 | 5/2001 | Ueno | |
| 6,319,106 | B2 | 11/2001 | Numoto | |
| 6,402,589 | B1 | 6/2002 | Inaba et al. | |
| 6,406,361 | B1 | 6/2002 | Zuniga et al. | |
| 6,514,124 | B1 | 2/2003 | Zuniga et al. | |
| 6,540,590 | B1 | 4/2003 | Kajiwara et al. | |
| 6,645,057 | B2 | 11/2003 | Quek | |
| 6,705,932 | B1 | 3/2004 | Zuniga et al. | |
| 6,729,946 | B2 | 5/2004 | Kimura | |
| 7,448,940 | B2 * | 11/2008 | Togawa | 451/5 |
| 2001/0007810 | A1 | 7/2001 | Moloney et al. | |
| 2001/0041522 | A1 * | 11/2001 | Shendon et al. | 451/288 |

FOREIGN PATENT DOCUMENTS

| | | |
|---|---|---|
| DE | 199 53 847 | 5/2000 |
| JP | 09-277164 | 10/1997 |
| JP | 10-193261 | 7/1998 |
| JP | 11042558 | 2/1999 |
| JP | 11165255 | 6/1999 |
| JP | 2000094311 | 4/2000 |
| JP | 2000141211 | 5/2000 |
| JP | 2001277098 | 10/2001 |
| JP | 20012980006 | 10/2001 |
| JP | 2002198329 | 7/2002 |
| JP | 2003145418 | 5/2003 |
| WO | WO 01/87541 | 11/2001 |

OTHER PUBLICATIONS

German Examination Report for related German application 103 93 369.7.
IPRP for PCT/JP03/012323.
Related International Publication W02004/028743A1.
Japanese Patent Office action dated Sep. 15, 2009 with translation for related application.

* cited by examiner

POLISHING APPARATUS, POLISHING HEAD AND POLISHING METHOD

This application is a divisional of U.S. patent application No. 10/528,287, filed on Mar. 16, 2005, which is a U.S. National Phase filing of International application No. PCT/JP03/12323, filed on Sept. 26, 2003.

TECHNICAL FIELD

The present invention relates to the manufacture of a semiconductor wafer or liquid crystal substrate or the like, and more particularly relates to an apparatus and polishing head for polishing the surface of a polishing target material comprising a flat surface such as a semiconductor wafer or liquid crystal substrate, and the method for the polishing thereof.

Herein, the term "final polishing" refers to the final polishing step of the polishing steps implemented in the manufacture of a wafer, and the term "coarse polishing" refers to polishing steps other than for final polishing.

BACKGROUND ART

FIG. 7 is a flow diagram illustrating the normal steps involved in the manufacture of a mirror-surface wafer of the prior art. With reference to the diagram, a general description will be given of a normal method for the manufacture of a mirror-surface wafer employed as a raw material wafer for the production of a semiconductor devices.

First, a single crystal ingot is grown by means of the Czochralski method (CZ method) or the floating zone melting method (FZ method) or the like (STEP 101). Because of distortions (warpage) in the peripheral shape of the grown single crystal ingot, the periphery of the ingot is ground by a cylindrical grinding machine or the like in an outer shape grinding step (STEP 102) to adjust the peripheral shape of the ingot. The ingot is sliced using a wire saw or the like in a slice step (STEP 103) to produce a disc-shaped wafer of thickness of the order of 500 to 1000 μm, and the periphery of the wafer is then further chamfered in a chamfering step (STEP 104).

Following this, the wafer is flattened by planar grinding and/or lapping or the like (STEP 105), and a chemical polishing process is administered thereon in an etching step (STEP 106). Furthermore, coarse polishing (STEP 107) and a final polishing (STEP 108) are implemented on the wafer surface, after which a wafer washing (STEP 109) is implemented to produce a mirror-surface wafer.

A very high level of flatness has been demanded in the production of high-precision devices in recent years for the production of semiconductor devices in which circuits are formed on the surface of mirror-surface wafers obtained by way of these steps. A low level of wafer surface flatness generates a problem whereby, because of the partial lack of focus of the lens focal point that occurs during exposure in the photolithography step, the formation of the minute patterns of a circuit is difficult. In addition, the flattening of the surfaces of not only semiconductor wafers but also other target materials for polishing comprising a flat surface such as liquid crystal substrates is demanded.

For the manufacture of a wafer with a very high level of flatness such as this the polishing of the wafer is regarded as extremely important. An example of a well-known general polishing apparatus for implementing this polishing is an apparatus that comprises a disc-shaped polishing plate to which an abrasive cloth is affixed to the upper surface and a wafer chuck for holding one surface of the wafer to be polished and pushing the other surface of the wafer against the abrasive cloth, the polishing being implemented by the supplying of a slurry between the wafer and the abrasive cloth and the relative rotation of the wafer and the polishing plate.

In addition, because the abrasive cloth is elastic, when polishing is implemented with the wafer only pushed against the abrasive cloth, the wafer embeds slightly into the abrasive cloth. When this happens, because of the concentration of elastic stresses from the abrasive cloth on the edge of the wafer, the pressure applied to the wafer is larger at the peripheral part than the center part and results in the excess polishing of the peripheral part of the wafer.

Apparatuses to alleviate this problem are available in which abrasive cloth deformation on the peripheral part of the wafer is suppressed so as to prevent excess polishing by the concentric arrangement of a toroidal presser ring with the periphery of the wafer chuck, and the pushing of the abrasive cloth by the presser ring at the desired pressure. An example thereof is the polishing apparatus disclosed in U.S. Pat. No. 6,350,346 as shown in FIG. 8. In this polishing apparatus a presser ring 52 is provided on the outer side of a wafer chuck 51, the wafer chuck 51 and the presser ring 52 can be relatively rotated, and the pressure force of each can be independently controlled. In addition, the presser ring 52 can be moved vertically with respect to a top ring 53.

However, in actual practice the production of a presser ring 52 that is perfectly parallel to the abrasive cloth 54 is very difficult. Notably, because only the presser ring 52 can be moved vertically in this constitution, the presser ring 52 and the abrasive cloth 54 are not formed perfectly in parallel and a distribution of the pressure generated at the pressing ring surface occurs during polishing which, accordingly, sometimes results in a worsening of the level of flatness of the wafer edge part worsens and the production of a polished wafer of an asymmetric shape.

DISCLOSURE OF THE INVENTION

With the foregoing problems of the prior art in view, it is a first object of the invention pertaining to the present application to provide a wafer polishing apparatus, and polishing method thereof that prevents a worsening of the flatness of the wafer edge part and prevents the production of a polished wafer of an asymmetric shape.

In addition, it is a second object of the invention pertaining to the present application to facilitate a reduction in apparatus costs by, without introduction of the abrasive grain used in coarse polishing into the final polishing stage, the implementation of coarse polishing and final polishing continuously using the same polishing head.

Furthermore, it is a third object of the invention pertaining to the present application to prevent the worsening of wafer flatness that has its origins in the processing precision of the retainer ring.

To achieve the objects described above, a first invention pertaining to the present application provides a polishing apparatus comprising a polishing plate provided with an abrasive cloth, a chuck for holding a polishing target material to bring the polishing target material into contact with the abrasive cloth, and a retainer ring arranged in a periphery of the chuck, the polishing target material being polished by the abrasive cloth by a relative motion of the polishing plate and the chuck, characterized in that the retainer ring and the chuck can be independently oscillated.

In addition, a second invention pertaining to the present application provides a polishing apparatus comprising a polishing plate provided with an abrasive cloth, a chuck for holding a polishing target material to bring the polishing target material into contact with the abrasive cloth, and a retainer ring arranged in a periphery of the chuck, the polishing target material being polished by the abrasive cloth by a relative motion of the polishing plate and the chuck, characterized in that the retainer ring can vertically move and oscillate with respect to the chuck.

Furthermore, a third invention, based on the first and second inventions, is characterized in that one or a plurality of clearances to facilitate the oscillation are provided.

In addition, a fourth invention, based on any of the first to third inventions, is characterized in that polishing is implemented while a gap of a fixed range between the chuck and the retainer ring is constantly maintained.

Furthermore, a fifth invention, based on the fourth invention, is characterized in that the range of the gap is between 0.5 mm and 2.0 mm.

In addition, a sixth invention, based on the fourth and fifth inventions, is characterized in that the distance between the center of the chuck and the center of the polishing target material is not more than 0.5 mm.

Furthermore, a seventh invention, based on any of the first to sixth inventions, is characterized in that the retainer ring is rotatable with respect to the chuck.

In addition, an eighth invention provides a method of wafer polishing in which, in a state in which a polishing liquid is interposed between a polishing target material and an abrasive cloth while the polishing target material held by a chuck is pushed against the abrasive cloth, the polishing of the polishing target material is implemented by the abrasive cloth by a relative motion of the chuck and polishing plate, characterized in that a retainer ring is provided to be vertically movable in a periphery of the chuck, and a pushing force of the retainer ring against the abrasive cloth is set in accordance with the polishing step.

In addition, a ninth invention, based on the eighth invention, is characterized in that the polishing in a coarse polishing step is implemented in a state in which the abrasive cloth is pushed by the retainer ring, and the polishing in a final polishing step is implemented in a state in which the retainer ring is retracted from the abrasive cloth.

Furthermore, a tenth invention provides a method of wafer manufacture comprising at least a coarse polishing step and a final polishing step, characterized in that a polishing head comprising a chuck for holding a polishing target material to bring it into contact with an abrasive cloth and a retainer ring arranged to be vertically movable in a periphery of the chuck is employed and, the polishing in the coarse polishing step is implemented in a state in which the abrasive cloth is pushed by the retainer ring, and the polishing in the final polishing step is implemented in a state in which the retainer ring is retracted from the abrasive cloth, to implement the coarse polishing step and the final polishing step using the same polishing head.

By virtue of the fact that, based on the abovementioned disclosed inventions, the abovementioned retainer ring and the abovementioned chuck can be independently pressurized at the optimum pressure and, moreover, they can mutually oscillate, a wafer polishing apparatus and polishing method therefor that facilitates the improvement of the flatness of the wafer edge part in the coarse polishing used for engendering flatness and prevents the production of a polished wafer of an asymmetric shape can be produced.

In addition, based on the present inventions, because the polishing in the abovementioned coarse polishing step is implemented in a state in which the abovementioned abrasive cloth is pushed by the abovementioned retainer ring and the polishing in the abovementioned final polishing step is implemented in a state in which the abovementioned retainer ring is retracted from the abovementioned abrasive cloth, the abrasive grain used for the coarse polishing is not introduced into the final polishing stage. In addition, due to the continuous implementation of the coarse polishing and the final polishing using the same polishing head, a reduction in apparatus costs can be achieved.

Furthermore, based on the present inventions, because the abovementioned retainer ring can be relatively rotated with respect to the abovementioned wafer chuck, a worsening of wafer flatness that has its origin in the processing precision of the abovementioned retainer ring and eccentric wear of the abovementioned retainer ring can be prevented by this rotating mechanism.

BEST MODE FOR CARRYING OUT THE INVENTION

A detailed description of the wafer polishing apparatus pertaining to the present invention is given below with reference to the diagrams. Provided there is no otherwise specific restricting description to the contrary, there are no particular restrictions to the material type, dimensions, shape and so on of the constituent components described in the embodiments below which constitute examples provided for the purpose of the description only for which the scope of the invention should not be regarded as restricted thereto. In addition, although the description of the following embodiments pertains to, as a specific example, the polishing of a silicon wafer, the present invention is in no way restricted thereto and, accordingly, it goes without saying that the present invention can have application in other thin film bodies of various kinds such as semiconductor substrates and liquid crystal glass substrates and so on.

Embodiment 1

Figure 1:
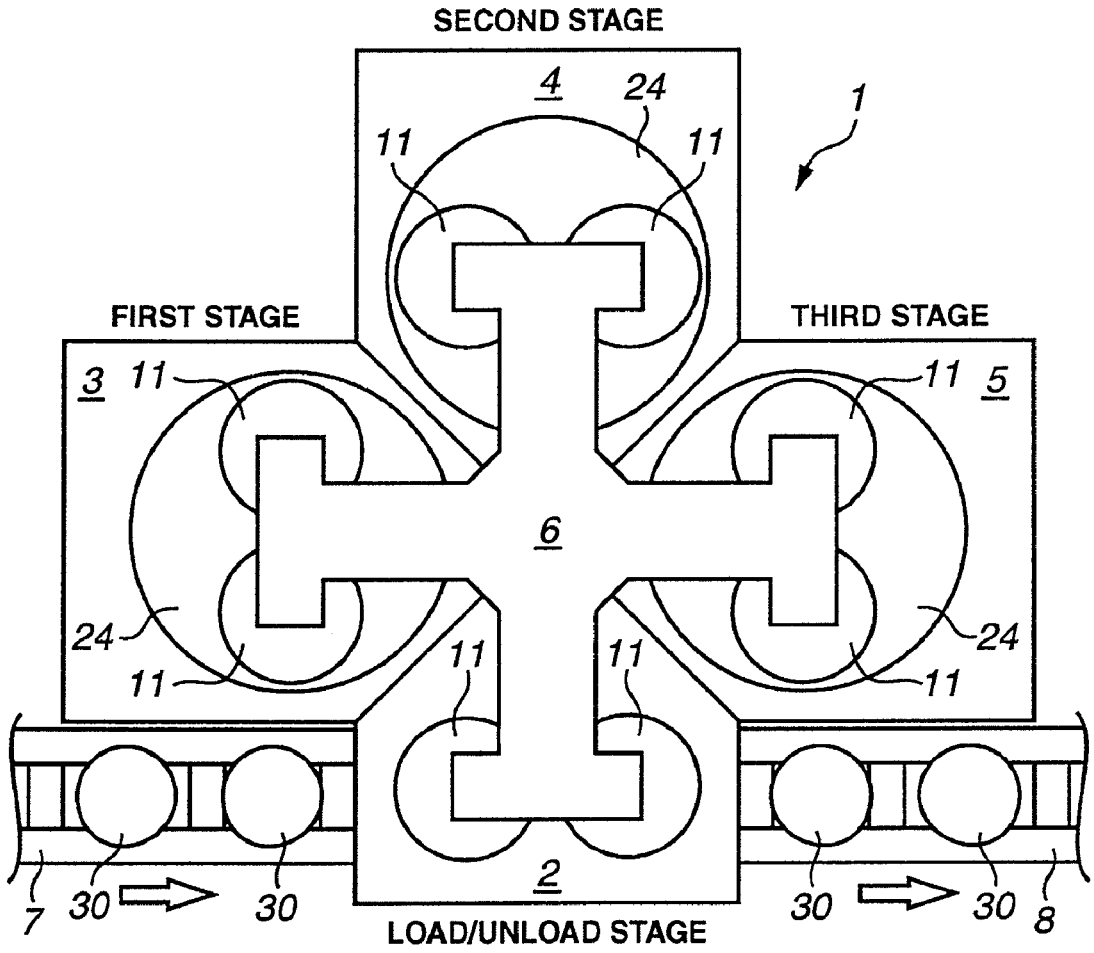
FIG. 1 is a full block diagram of a wafer polishing apparatus pertaining to a first embodiment.
Figure 2:
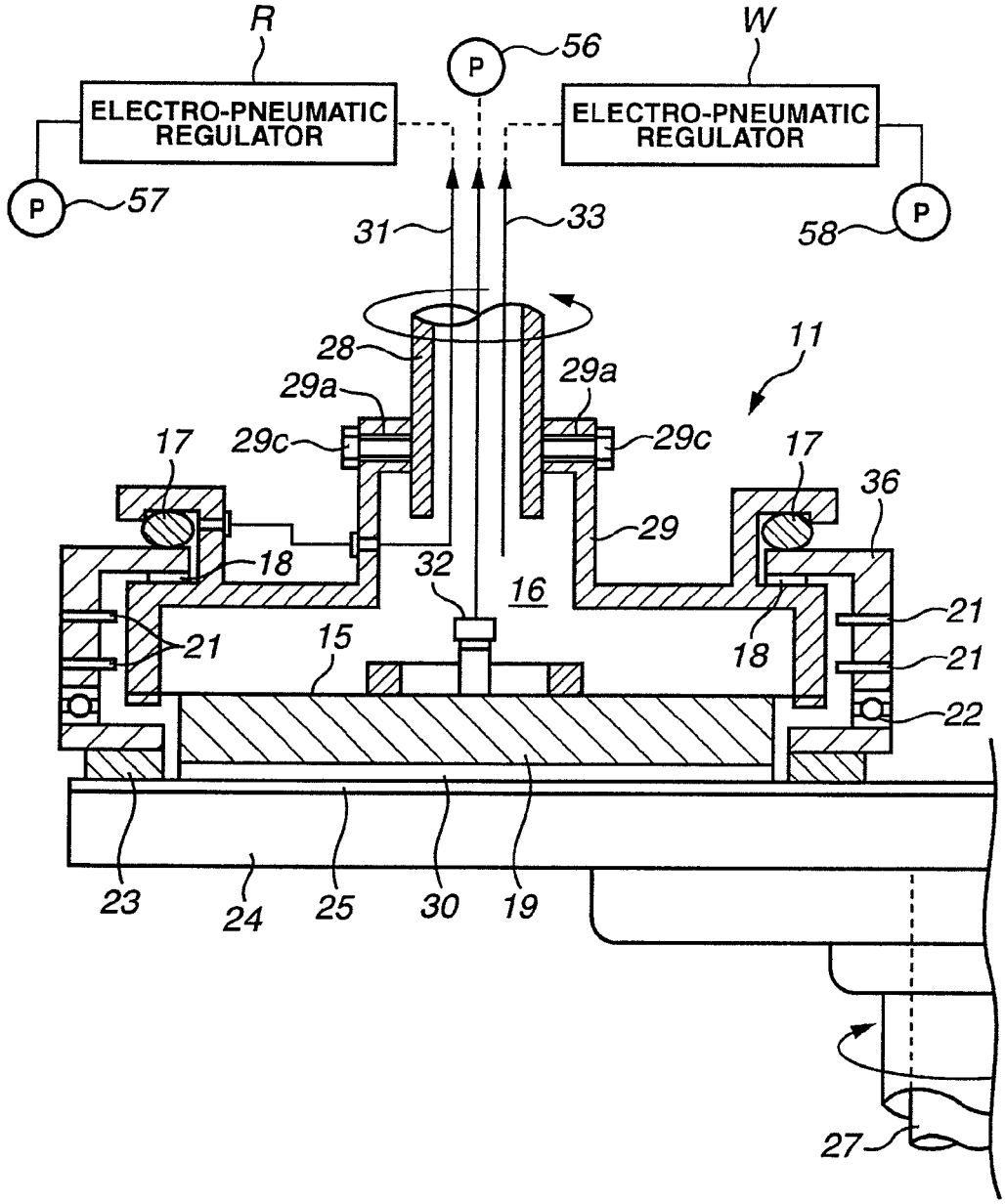
FIG. 2 is a cross section of a first stage 3 and a second stage 4 of a tube pressure-type polishing head 11 pertaining to the first embodiment.
Figure 3:
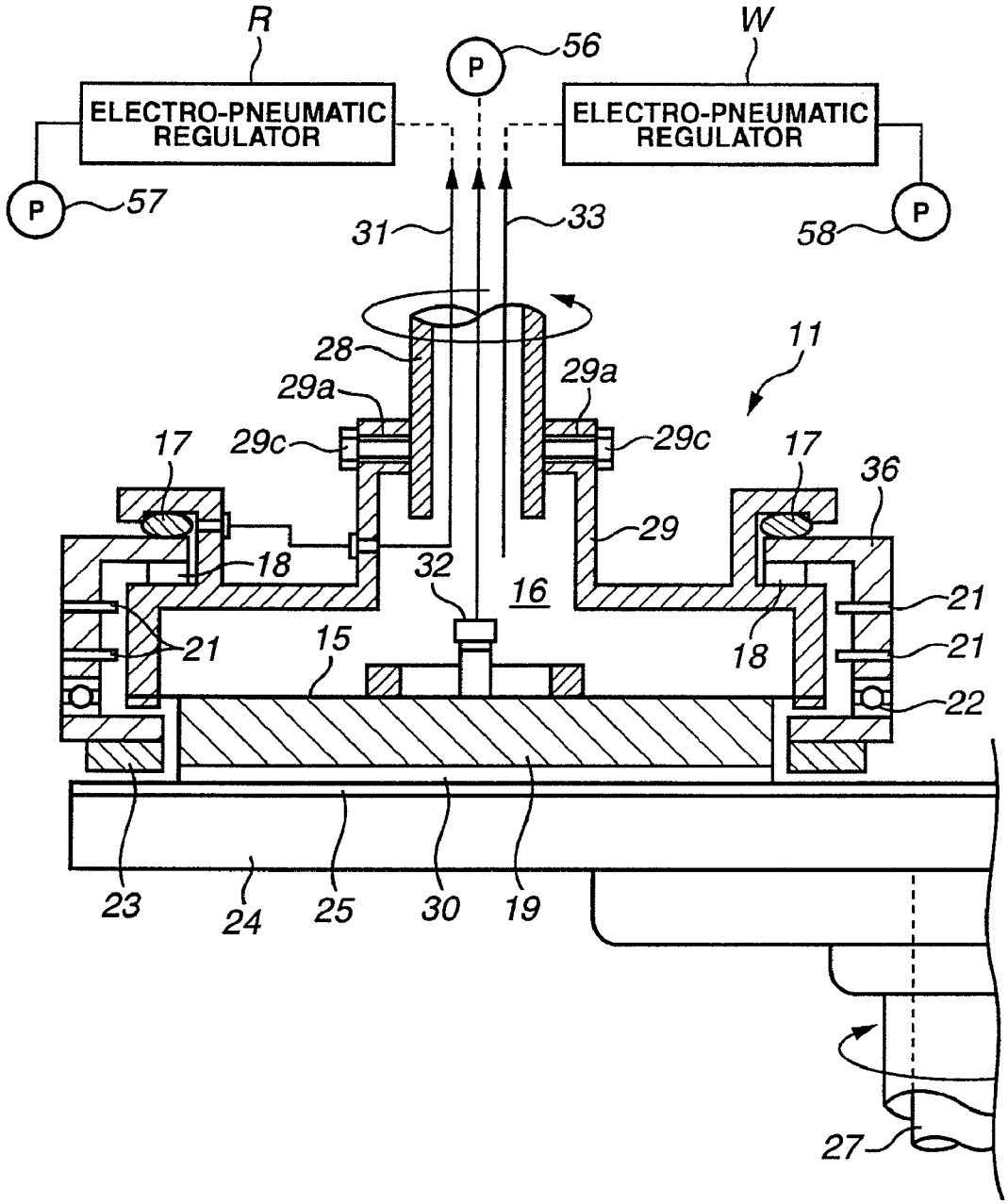
FIG. 3 is a vertical cross section of a third stage 5 of the tube pressure type polishing head 11 pertaining to the first embodiment.

First, a description will be given of a first embodiment with reference to FIG. 1 to FIG. 3. FIG. 1 is a full block diagram of a wafer polishing apparatus of the present invention, FIG. 2 is a cross section of a first stage 3 and a second stage 4 of an airbag pressure-type polishing head 11 pertaining to this embodiment, and FIG. 3 is a vertical cross section of a third stage 5 of the airbag pressure type polishing head 11 pertaining to this embodiment.

First, a brief description of the constitution of the wafer polishing apparatus as a whole will be given with reference to FIG. 1. FIG. 1 is a plan view of a polishing apparatus 1 comprising the polishing head 11 of the present invention that comprises first to third stages 3, 4 and 5 and a wafer load/unload stage 2.

The first stage 3 and second stage 4 form a coarse polishing step and the third stage 5 forms a final polishing step, the coarse polishing step being provided to control the removal of the processing damage incurred on the wafer surface in previous steps and to engender wafer flatness, while the final polishing step is provided to support the removal of the processing damage incurred in the coarse polishing step and to engender wafer flatness. The division of the coarse polishing into two steps is based on the relationship between the time required for the coarse polishing and the time required for the final polishing and is designed with consideration to the overall through-put.

A cross-shaped polishing head support part 6 is provided in the upper-center part of the polishing apparatus 1, and the polishing head support part 6 is arranged with freedom to rotate within the horizontal plane about the vertical axis. Two polishing heads 11 are provided facing vertical downward in each end of the polishing head support part 6 making a total of eight polishing heads 11 overall.

FIG. 2 and FIG. 3 are vertical cross sections of the polishing heads 11 fixed to the end of the polishing head support part 6 and a polishing plate 24 that is affixed to the bottom thereof and although, for the convenience of the description, only the left half of one polishing head 11 and polishing plate 24 are shown, an opposing symmetrical structure exists on the right side with respect to the center axis thereof. The polishing plate 24 of the first to third stages 3, 4 and 5 is disc-shaped and is held horizontally and, as shown in FIG. 2, a coarse polishing abrasive cloth 25 is affixed to the upper surface of the polishing plate 24 in the first and second stages 3 and 4 and, as shown in FIG. 3, a final abrasive cloth 26 is affixed to the upper surface in the third stage 5.

Because uniform distribution of the abrasive grain is essential from the viewpoint of increasing the efficiency of the polishing, a foamed material such as urethane throughout which air bubbles are uniformly dispersed is employed as the coarse polishing abrasive cloth 25 and the final abrasive cloth 26 material, and these air bubbles function as a holding site for the abrasive grain. A spindle 27 is vertically linked to the lower part of the polishing plate 24, and the spindle 27 is linked to the rotating shaft of a polishing plate rotating motor not shown in the diagram. The polishing plate 24 is driven by a polishing plate rotating motor to rotate in the horizontal plane about the spindle 27. A polishing liquid supply nozzle not shown in the diagram is arranged above the center of the polishing plate 24, and the polishing liquid supply nozzle is connected to a polishing liquid supply tank not shown in the diagram.

In stages 3 to 5 two wafers 30 are simultaneously polished by two polishing heads 11 and, following the completion of this polishing, are sent at regular timings to the next step in a continuous polishing process. At this time, prior to the movement from the coarse polishing step of the second stage 4 to the final polishing step of the third stage 5, the wafers are temporarily moved to the load/unload stage 2 where, in such a way that the abrasive grain attached to the polishing head 11 in the coarse polishing step can be washed off with water, a nozzle is arranged to spray a jet water flow in the load/unload stage 2.

Next, a detailed description will be given of the tube pressure-type polishing head 11 of this embodiment with reference to FIG. 2. The polishing head 11 comprises a shaft 28, frame 29, airbag 15, wafer chuck 19, retainer frame 36 and retainer ring 23 and so on. The reference symbol 28 in the diagram refers to a hollow cylindrical shaft 28, and the frame 29 is arranged on the periphery of this shaft. The frame 29 has four female screw parts 29*a* radially provided from the center axis of the shaft 28 at intervals of 90°, and the frame 29 is fixed to the shaft 28 by the screw-insertion of bolts 29*c* through the female screw parts 29*a* from the outer side.

An airbag 15 is formed by the fixing of a disc-shaped plate spring and plate rubber to the lower end part of the frame 29 and the use of the hollow part partitioned by the plate rubber and frame 29 as an air chamber 16. A disc-shaped wafer chuck 19 is fixed to the lower surface of the airbag 15. The upper-center part of the wafer chuck 19, which constitutes a porous ceramic plate hard chuck base, is connected to a vacuum pump 56 by way of a vacuum pipe 32 that passes though the airbag 15.

Meanwhile, the frame 29 comprises on the peripheral part of its upper surface a cylindrical protruding part extending in the vertical direction and, continuous with this protruding part, a flange part formed to project in the outer circumferential horizontal direction. A donut-shaped airbag 17 is provided immediately below the flange part, and further therebelow twelve compression springs 18 are provided at intervals of 30°. The retainer frame 36 is sandwiched and supported between the airbag 17 and the compression springs 18.

The retainer frame 36, which is a toroidal member with a U-shape cross section, comprises a retainer ring 23 in its lower surface. The retainer frame 36 comprises a flange part in its upper part formed to project in the inner circumferential horizontal direction. A through-hole is formed in this flange part in such a way as to provide a prescribed clearance for the outer surface of the cylindrical-shaped protruding part of the frame 29. The flange part is supported by the urging from below by the compression springs 18 and the urging from above by the airbag 17.

Because the airbag 17 constitutes a single donut-shaped tube, the interior air pressure is uniformly generated at the outer surface of the tube. Accordingly, by way of example, even when an eccentric load is applied that pushes the retainer frame 36 of FIG. 2 upward on a part of the airbag 17 from the right side, this eccentric load is formed uniformly within the airbag 17 and generates a push-down force from the left side of the airbag 17 that pushes the retainer frame 36 downward. As a result, the retainer frame 36 can be oscillated with respect to the frame 29 and centered with respect to the surface of the abrasive cloths 25, 26.

In addition, the adoption of a constitution in which the retainer frame 36 can be oscillated and centered in this way necessitates a mechanism for maintaining the minimum gap between the retainer frame 36 and wafer chuck 19. Accordingly, ball plungers 21 are provided vertically in two positions, making an overall total of sixteen at intervals of 45° with respect to the rotating shaft, along the length of a half-way part of the retainer frame 36. The reason the ball plungers 21 are vertically provided in two positions is because, even if the ball plungers 21 lift up accompanying the lifting of the retainer frame 36, the function whereby the minimum distance between the frame 29 and the retainer frame 36 is maintained can be fulfilled by either of the ball plungers 21. In addition, by the provision of a mechanism by which this minimum gap can be maintained, contact between the wafer that is affixed to the wafer chuck 19 with a prescribed positional precision and the retainer ring 23 can be prevented.

Furthermore, a ball bearing 22 is provided in a lower half-way part of the retainer frame 36, and the toroidal retainer ring 23 is fixed to the lower surface of the retainer frame 36 on the lower side from the ball bearing 22. The retainer ring 23 is arranged essentially concentrically and horizontally with the wafer chuck 19 with a gap of 0.5 to 2.0 mm with the adsorbed wafer and the periphery of the wafer chuck 19 that is of approximately the same outer diameter. The retainer ring 23, which is smoothly rotatable with the retainer frame 36 by means of the ball bearing 22, rotates relatively with the wafer chuck 19. As a result of this rotating mechanism a worsening of wafer flatness that has its origins in the processing precision of the retainer ring 23, eccentric wear of the retainer ring 23, and the generation of shear forces generated in the retainer ring 23 (twist), can be prevented.

The airbag 17 is connected to an electro-pneumatic regulator R by way of a retaining pressurizing pipe 31, and an air chamber 16 is connected to an electro-pneumatic regulator W by way of a wafer pressurizing pipe 33. A compressed air pump 57 is connected to the end of the electro-pneumatic regulator R, and a compressed air pump 58 is connected to the end of the electro-pneumatic regulator W.

Meanwhile, although not shown in the diagram, a timing pulley is provided in the peripheral part of the upper part of the shaft 28. The timing pulley, by way of a timing belt, is connected to a timing pulley provided in a polishing head rotating motor. It should be noted that the upper-end part of the shaft 28 and base part of the polishing head rotating motor are linked to a cylinder fixed to the polishing head support part 6 and the polishing head 11 is vertically movable.

Although a hard chuck base composed of a porous ceramic plate is employed as the wafer chuck 19 in this embodiment, a pin chuck, ring chuck or ball chuck may be employed as the wafer chuck 19. In addition, although sixteen ball plungers 21 formed at intervals of 45° and twelve compression springs 18 formed at intervals of 30° are provided in this embodiment, the number of ball plungers 21 and compression springs 18 is not restricted thereto and, provided the number thereof is within a range by which the desired functions can be achieved, this number may be higher or lower.

Next, a description will be given with reference to FIG. 1 to FIG. 3 of a method for the polishing of a wafer 30 based on the wafer polishing apparatus 1 of the constitution described above.

In the load/unload stage 2 the unpolished wafer 30 is moved directly below the wafer chuck 19 of the polishing head 11 by a wafer carry device 7. Next, due to the suction of the vacuum pump 56, a negative pressure is formed by way of the vacuum pipe 32 in the interior of the porous ceramic plate and the unpolished wafer 30 is adsorbed on to the lower surface of the wafer chuck 19. This adsorption-positioning is implemented at this time in such a way so that the distance between the center of the wafer chuck 19 and the center of the unpolished wafer 30 is not more than 0.5 mm. In the loading of the unpolished wafer 30 the polishing head support part 6 is rotated 90° to the right and the polishing head 11 on which the unpolished wafer has been adsorbed is moved to the first stage 3.

Next, the electro-pneumatic regulator W is driven to supply compressed air from the compressed air pump 58 to the air chamber 16 by way of the wafer pressurizing pipe 33, and a state in which the airbag 15 in its entirety is uniformly pushed at a pressure of 5 g/mm$^2$ is maintained by means of the air within the air chamber 16. Thereafter, the polishing head 11 and polishing plate 24 are relatively rotated by the drive of the polishing head rotating motor and the polishing plate rotating motor, and the polishing liquid is supplied through the polishing liquid supply nozzle. In this state a cylinder not shown in the diagram is driven to lower the polishing head 11 until the wafer 30 contacts the coarse polishing abrasive cloth 25.

The wafer 30 is subjected to a uniform pressure of 5 g/mm$^2$ across its whole surface and pushed against the coarse polishing abrasive cloth 25 for the target surface for polishing thereof to be polished flat. Because the airbag 15 is formed from a plate rubber and a plate spring, the wafer chuck 19 can be oscillated and centered to conform to distortions in the surface of the coarse polishing abrasive cloth 25. Accordingly, the wafer 30 is maintained in a constant parallel state with respect to the surface of the coarse polishing abrasive cloth 25 and the wafer is pushed at a uniform pressure over its entirety against the coarse polishing abrasive cloth 25.

During the implementation of the abovementioned coarse polishing step the electro-pneumatic regulator R is driven and compressed air is supplied to the airbag 17 from the compressed air pump 57 by way of the retaining pressurizing pipe 31. As a result, the airbag 17 expands and, resisting the compression springs 18, the retainer frame 36 is urged downward and the retainer ring 23 is pushed on to the coarse polishing abrasive cloth 25. Because the retainer frame 36 is supported by the airbag 17 and the compression springs 18, the retainer frame 36 and the retainer ring 23 can be oscillated and centered on the surface of the coarse polishing abrasive cloth 25 independently of the wafer chuck 19.

Accordingly, a state in which the retainer ring 23 is parallel to the surface of the coarse polishing abrasive cloth 25 is constantly maintained and the retainer ring 23 is pushed over its entirety at a uniform pressure on to the coarse polishing abrasive cloth 25. At this time, in such a way that a retainer ring pressurizing force of 5 g/mm$^2$ equal to the wafer pressurizing force is formed, it is desirable for the compressed air pressure supplied to the airbag 17 to be regulated. By the equalizing of the retainer ring pressurizing force with the wafer pressurizing force, deformation of the coarse polishing abrasive cloth 25 in the periphery of the wafer 30 can be suppressed to prevent excessive polishing. In addition, the retainer ring pressurizing force can be regulated in accordance with the final shape of the wafer 30 following polishing.

In this way, the wafer pressurizing force can be regulated by the regulating of the air pressure supplied by the electro-pneumatic regulator W and the retaining pressurizing force can be regulated by the regulating of the air pressure supplied by the electro-pneumatic regulator R. Accordingly, the desired wafer pressurizing force and retaining pressurizing force can be set independently. In addition, because the wafer chuck 19 and the retainer ring 23 described above comprise independent automated centering functions each is constantly maintained in parallel with the polishing surface of the coarse polishing abrasive cloth 25.

In addition because ball plungers 21 are provided on the inner side of the retainer frame 36, the gap between the retainer ring 23 and the wafer chuck 19 can be set within a fixed range. The optimum polishing effect can be produced in this embodiment mode when this gap is set between 0.5 mm and 2.0 mm. When the gap is 2.0 mm or more the flatness of the wafer following polishing worsens.

Thereupon, taking the gap between the retainer ring 23 and the wafer chuck 19 in the standard state is taken as 1.0 mmm, the gap between the ball part of the ball plunger 21 and the frame 29 is 0.1 mm and the spring stroke of the ball plunger 21 is 0.4 mm. As a result, even when the retainer ring 23 and the wafer chuck 19 oscillate the gap is stabilized and fluctuates within a range of 0.5 mm to 1.5 mm.

A slurry or similar composed of a coarse polishing abrasive grain of SiC or SiO or the like of diameter of the order of 12 nm and a water-based or oil-based liquid can be employed as the polishing liquid of the coarse polishing step. The polishing head 11 and the polishing plate 24 are relatively rotated while the polishing liquid is supplied in this way, and the coarse polishing of the wafer 30 is implemented for 5 minutes.

Following the implementation of coarse polishing, the cylinder is driven to lift the polishing head 11 and the polishing head support part 6 is rotated 90° to the right to move the polishing 11 to the second stage 4.

When the polishing head 11 is moved to the second stage 4, identical to the action of the first stage 3, the polishing head 11 is lowered to polish the wafer 30. The point of difference with the first stage 3 in terms of the processing conditions lies in the establishment of each of the wafer pressurizing force and the retaining pressurizing force as 2 g/mm$^2$, and the adoption of a polishing time of 2 minutes.

Following the coarse polishing, the cylinder is driven to lift the polishing head 11 and the polishing head support part 6 is rotated 180° to the right to move the polishing head 11 to the load/unload stage 2.

In order to prevent the introduction of the abrasive grain for coarse polishing into the final polishing stage when the polishing head 11 is moved to the load/unload stage 2, the abrasive grain attached to the target surface for polishing of the wafer 30 and the retainer ring 23 is washed for 10 seconds by distilled water or ozone water using a jet water flow jetted from a nozzle.

Following the washing of the polishing head 11, the polishing head support part 6 is rotated 90° to move the polishing head 11 to the third stage 5.

Because of the low wafer pressurizing force of 1 g/mm$^2$ the extent to which the wafer 30 is embedded into the final abrasive cloth 26 is negligible. Accordingly, there is no generation of the problem of a concentration of the elastic stresses from the final abrasive cloth 26 on the edge of the wafer 30 resulting in excessive polishing of the periphery of the wafer In addition, because the actual polished amount is small, there is no need for the use of a retainer ring 23.

Thereupon, in this embodiment, in the course of the movement to the third stage 5, the pressure of the airbag 17 is released and the retainer ring 23 is retracted upward by the reactive force of the springs 18. The extent of this movement is set to approximately 5 mm. This is to prevent introduction of the abrasive grain for coarse polishing attached to the retainer ring 23 into the final polishing stage.

When the polishing head 11 is moved into the third stage 5, the electro-pneumatic regulator W is driven to supply a compressed air to the air chamber 16 from the compressed air pimp 58 by way of the wafer pressurizing pipe 33, and a state in which the airbag 15 in its entirety is pushed at a pressure of 1 g/mm$^2$ by the air within the air chamber 16 is maintained. Thereafter, the polishing head 11 and polishing plate 24 are relatively rotated by the drive of the polishing head rotating motor and the polishing plate rotating motor, and the polishing liquid is supplied through a polishing liquid supply nozzle. In this state a cylinder not shown in the diagram is driven to lower the polishing head 11 until the wafer 30 contacts the final abrasive cloth 26.

The wafer 30 is subjected to a uniform pressure of 1 g/mm$^2$ across its entire surface and pushed against the final abrasive cloth 26 for the target surface for polishing thereof to be polished flat. Because the airbag 15 is composed of rubber and a plate spring, the air chuck 19 can be oscillated and centered to conform to the surface shape of the final abrasive cloth 26. Accordingly, the wafer 30 is maintained in a constant parallel state with respect to the final abrasive cloth 26 and the wafer is pushed at a uniform pressure across its entirety against the final abrasive cloth 26.

A slurry or similar composed of a coarse polishing abrasive grain of SiC and SiO or the like of diameter of the order of 5 to 500 nm and a water-based or oil-based liquid can be employed as the polishing liquid of the final polishing step. The polishing head 11 and the polishing plate 24 are relatively rotated while the polishing liquid is supplied in this way, and the final polishing of the wafer 30 is implemented for 5 minutes.

Following the implementation of the final polishing, the cylinder is driven to lift the polishing head 11 and the polishing head support part 6 is rotated 90° to the right to move the polishing 11 to the load/unload stage 2.

When the polishing head 11 is moved to the load unload stage 2 a carry hand not shown in the diagram of the wafer carry device 8 is moved directly below the wafer chuck 19. Next, when the vacuum pump 56 is stopped, the adsorption forces of the wafer chuck 19 are released and the wafer 30 adsorbed on the wafer chuck 19 is loaded on the wafer carry hand whereupon, thereafter, it is carried out by the wafer carry device 8. The steps for the polishing of the wafer 30 are completed in accordance with the above.

Embodiment 2

Figure 4:
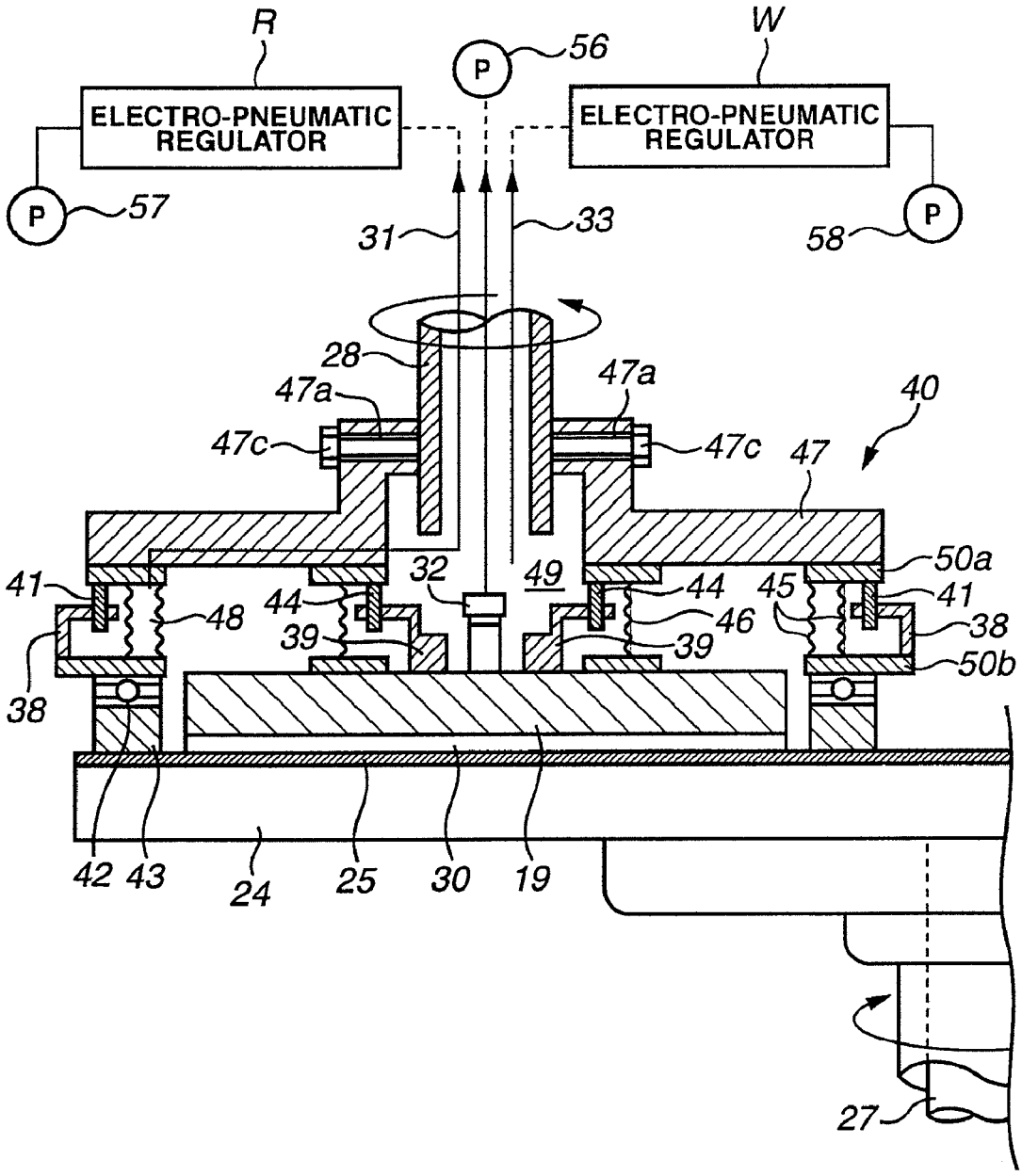
FIG. 4 is a vertical cross section of a first stage 3 and a second stage 4 of a bellows pressure-type polishing head 40 pertaining to a second embodiment.
Figure 5:
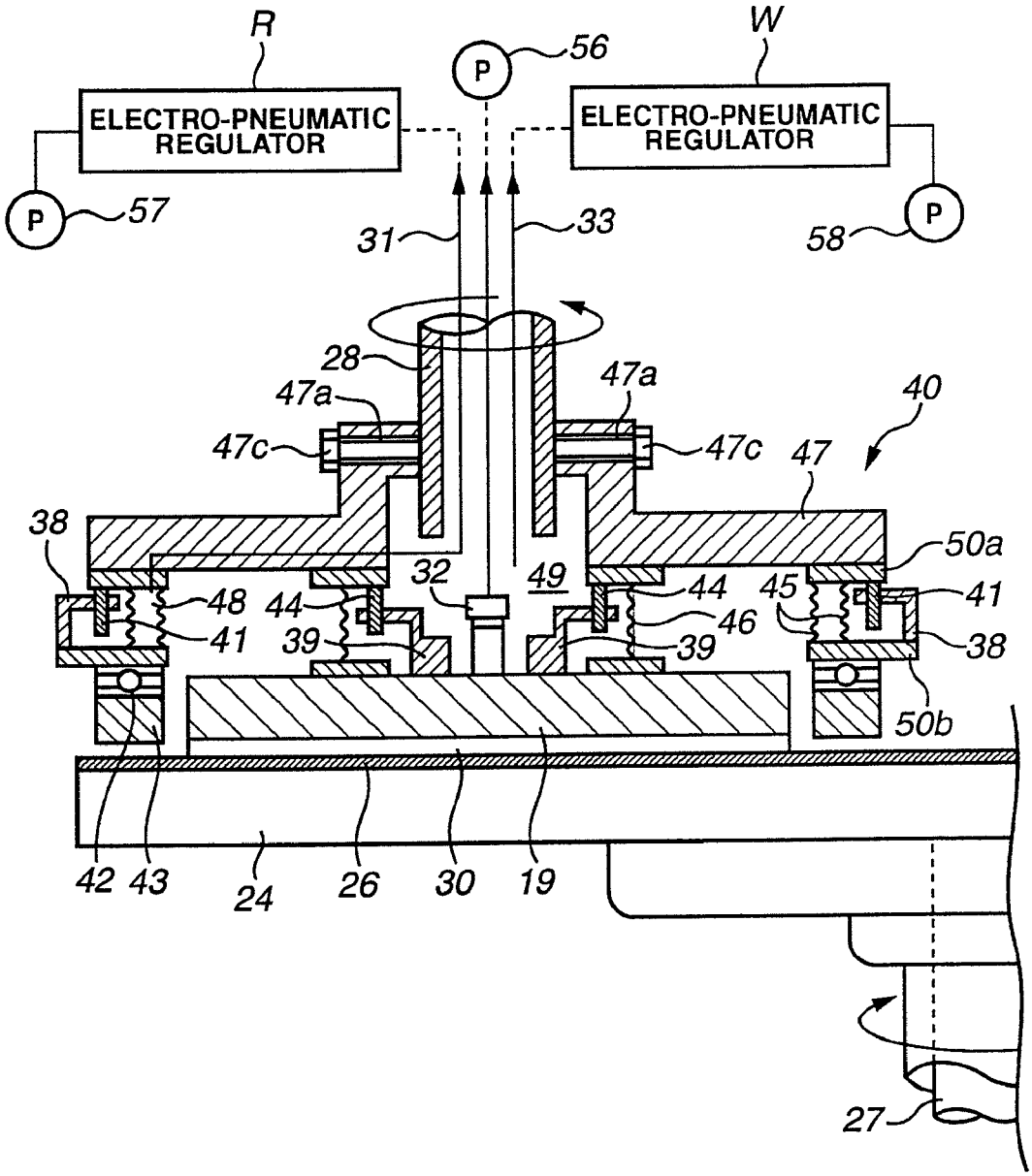
FIG. 5 is a vertical cross section of a third stage 5 of the bellows pressure-type polishing head 40 pertaining to the second embodiment.

Next, a description will be given of a second embodiment with reference to FIG. 4 and FIG. 5. FIG. 4 is a vertical cross section of a first stage 3 and a second stage 4 of a bellows pressure-type polishing head 40 pertaining to a second embodiment of the present invention, and FIG. 5 is a vertical cross section of the third stage 5 of the bellows pressure-type polishing head 40 pertaining to this embodiment.

Because the overall constitution of this embodiment is identical to the overall constitution of the first embodiment shown in FIG. 1, the description is given with reference to FIG. 4 and pertains only to the points of difference of the constitution of the polishing head 40. FIG. 4 is a vertical cross section of the polishing head 40 fixed to the end of the polishing head support part 6 and a polishing plate 24 arranged therebelow and, although, for the convenience of the description, only the left half of one polishing head 40 and polishing plate 24 is shown, an opposing symmetrical structure exists on the right side with respect to the center axis thereof.

The bellow pressure-type polishing head 40 of this embodiment comprises a shaft 28, frame 47, bellows 45, 46, wafer chuck 19, guide pins 41, 44, ball bearing 42, and retainer ring 43 and so on. The reference symbol 28 in the diagram refers to a hollow cylindrical shaft 28, and a frame 47 is arranged on the outer circumference of this shaft. The frame 47 has 4 female screw parts 47*a* radially provided from the center axis of the shaft 28 at intervals of 90°, and the frame 47 is fixed to the shaft 28 by the screw-insertion of bolts 47*c* through the female screw parts 47*a* from the outer side.

An upper-part retainer frame 50*a*, formed as a disc-shaped thin plate, is mounted on the outer circumferential lower surface of the frame 47. Two concentric cylindrical bellows 45 are fixed facing vertically downward to the lower surface of the upper-part retainer frame 50*a*, and the lower ends of the bellows 45 are mounted on the upper surface of a lower-part retainer frame 50*b* formed as-a disc-shaped thin plate. A toroidal airtight space enclosed by the two bellows 45, the upper-part retainer frame 50*a* and the lower-part retainer frame 50*b* forms an air chamber 48.

A ball bearing 42 is further provided below the lower-part retainer frame 50*b*, and a toroidal retainer ring 43 is fixed below the ball bearing 42. The retainer ring 43 is arranged essentially concentrically with the wafer chuck 19 with a very small gap with the adsorbed wafer and the peripheral part of the wafer chuck 19 of approximately the same diameter. The retainer ring 43 is formed as a constitution able to be relatively rotated smoothly with respect to the wafer chuck 19 by means of the ball bearing 42. Using this rotating mechanism based on the ball bearing 42, a worsening of the wafer flatness that is attributed to the processing precision of the retainer ring 43, eccentric wear of the retainer ring 43, and the generation of shear stress that is generated in the retainer ring 43 (twist) can be prevented.

Furthermore, because the retainer ring 43 is suspended from and held by the bellows 45 and the bellows 45 are produced from Hastelloy or the like and therefore expandable, the retainer ring 43 can be oscillated with respect to the frame 47. In addition, because the constitution adopted is one in which the retainer ring 43 can be oscillated in this way, in order for the fluctuations of the gap between the retainer ring 43 and the wafer chuck 19 to be able to be maintained within a fixed range, six cylindrical guide pins 41, provided vertically downward in the upper-part retainer frame 50*a*, and six guide pin receivers 38, formed from a plate material bent into an L-shape and fixed in the upper surface of the lower-part retainer frame 50*b*, are provided at intervals of 60°. In order to maintain the oscillation within a fixed range, a through-hole with a prescribed clearance to the guide pins 41 is provided in the guide pin receivers 38, and the guide pins 41 are inserted through these through-holes.

On the other hand, further on the inner side of the inner circumferential side of the bellows 45 a cylindrical-shaped bellows 46 is affixed facing vertically downward to the lower end part of the frame 47, and the wafer chuck 19 is fixed to the lower end of the bellows 46. An airtight space enclosed by the bellows 46 and the wafer chuck 19 forms an air chamber 49.

Within the bellows 46, six cylinder guide pins 44, provided vertically downward from the frame 47, and six guide pin receivers 39, formed from a plate material bent into an L shape from the wafer chuck 19, are fixed at intervals of 60°. In order to maintain the oscillation within a fixed range, a through-hole with a prescribed clearance to the guide pins 44 is provided in the guide pin receivers 39, and the guide pins 44 are inserted through these through-holes.

In addition, the wafer chuck 19 comprises a hard chuck base composed of a porous ceramic plate, and the upper-center part thereof is connected to the vacuum pump 56 by way of the vacuum pipe 32.

The air chamber 48 formed between the two bellows 45 is connected to the electro-pneumatic regulator R by way of the retaining pressurizing pipe 31, and the air chamber 49 is connected to the electro-pneumatic regulator W by way of the wafer pressurizing pipe 33. A compressed air pump 57 is connected to the end of the electro-pneumatic regulator R and a compressed air pump 58 is connected to the end of the electro-pneumatic regulator W.

Although not shown in the diagram, a timing pulley is provided in the peripheral part of the upper part of the shaft 28. The timing pulley is connected to a timing pulley provided in the polishing head rotating motor by way of a timing belt. It should be noted that the upper-end part of the shaft 28 and the base part of the polishing head rotating motor are connected to a cylinder fixed to the polishing head support part 6 and the polishing head 11 is able to be moved vertically.

Although a hard chuck base composed of a porous ceramic plate is employed as the wafer chuck 19 in this embodiment, a pin chuck, ring chuck or ball chuck may be employed as the wafer chuck 19. In addition, although six guide pins 41, 44 are provided at intervals of 60°, provided the number is within a range by which the desired functions thereof can be achieved, the number of guide pins 41, 44 may be greater or smaller than six.

Next, a description is given below with reference to FIG. 1 and FIGS. 4 and 5 of the method for the polishing of the wafer 30 using the polishing apparatus 1 comprising the polishing head 40 described above. The polishing head 40 in the description of this embodiment replaces the polishing head 11 of FIG. 1.

In the load/unload stage 2 the unpolished wafer 30 is moved directly below the wafer chuck 19 of the polishing head 40 by a wafer carry device 7. Next, due to the suction of the vacuum pump 56, a negative pressure is formed in the interior of the porous ceramic plate by way of the vacuum pipe 32, and the unpolished wafer 30 is adsorbed on to the lower surface of the wafer chuck 19. The adsorption-positioning is implemented at this time in such a way that the distance between the center of the wafer chuck 19 and the center of the unpolished wafer 30 is not more than 0.5 mm. In the loading of the unpolished wafer 30 the polishing head support part 6 is rotated 90° to the right and the polishing head 40 on which the unpolished wafer has been adsorbed is moved to the first stage 3.

Next, as shown in FIG. 4, the electro-pneumatic regulator W is driven to supply compressed air from the compressed air pump 58 to the air chamber 49 by way of a wafer pressurizing pipe 33, and a state in which the wafer chuck 19 in its entirety is pushed uniformly at a pressure of 5 g/mm$^2$ due to the air within the air chamber 49 is maintained. Thereafter, the polishing head 40 and polishing plate 24 are relatively rotated by the drive of the polishing head rotating motor and the polishing plate rotating motor, and the polishing liquid is supplied through the polishing liquid supply nozzle. In this state, a cylinder not shown in the diagram is driven to lower the polishing head 40 until the wafer 30 contacts the coarse polishing abrasive cloth 25. The wafer 30 is subjected to a uniform pressure of 5 g/mm$^2$ across its entire surface to be pushed against the coarse polishing abrasive cloth 25 for the target surface for polishing thereof to be polished flat.

Because the bellows 46 are produced from Hastelloy or the like and therefore are expandable, the wafer chuck 19 is movable and can be centered to conform to the surface shape of the coarse polishing abrasive cloth 25. Accordingly, the parallel state of the wafer 30 with respect to the coarse polishing abrasive cloth 25 is constantly maintained and the coarse polishing abrasive cloth 25 is pushed at a uniform pressure over the entirety of the wafer.

During the implementation of the coarse polishing step described above, the electro-pneumatic regulator R is driven and a compressed air of higher pressure than air pressure is supplied to the air chamber 48 by way of the retaining pressurizing pipe 31 from the compressed air pump 57, and a state in which the lower-part retainer frame 50*b* pushes the retainer ring 43 against the coarse polishing abrasive cloth 25 at a pressure of 5 g/mm$^2$ due to the pressure of the air chamber 48 is maintained By the equalizing of the retainer ring pressurizing force and the wafer pressurizing force in this way, deformation of the coarse polishing abrasive cloth 25 in the peripheral part 30 of the wafer can be suppressed to prevent excessive polishing. In addition, the retainer ring pressurizing force can be regulated in accordance with the final shape of the wafer 30 following polishing.

Here, because the retainer ring 43 is suspended to the frame 47 by means of the bellows 45, the retainer ring 43 can oscillate independently of the wafer chuck 19 and can be centered to conform to the surface shape of the coarse polishing abrasive cloth 25 independent of the centering of the wafer chuck 19.

Accordingly, the retainer ring 43 is maintained in a constant parallel state with the coarse polishing abrasive cloth 25 and the retainer ring 43 is pushed against the coarse polishing abrasive cloth 25 at a uniform pressure across the entirety thereof. Because the wafer pressurizing force is regulated by the regulating of the air pressure supplied to the air chamber 49 by the electro-pneumatic regulator W and the retaining pressurizing force is regulated by the regulating of the air pressure supplied to the air chamber 48 by the electro-pneumatic regulator R in this way, the wafer pressurizing force and the retaining pressurizing force can be independently set to prescribed pressurizing forces. In addition, because the wafer chuck 19 and the retainer ring 43 comprise independent automatic centering mechanisms in this way, each can be constantly maintained in parallel with the abrasive cloth 25.

In addition, guide pins 41, 44 are provided in the polishing head 40, and the fluctuation of the gap between the retainer ring 43 and the wafer chuck 19 is set to within a fixed range. The optimum polishing effect can be produced in this embodiment mode when this gap is between 0.5 mm and 2.0 mm. When the gap is 2.0 mm or more the flatness of the wafer following polishing worsens. Thereupon, a through hole of a hole diameter by which the gap between the retainer ring 43 and the wafer chuck 19 lies within the range of 0.5 mm to 2.0 mm is formed in the guide pin receivers 38, 39.

A slurry or similar composed of a coarse polishing abrasive grain of SiC and SiO of diameter of the order of 12 nm or the like and a water-based or oil-based liquid can be employed as the polishing liquid of the coarse polishing step. The polishing head 40 and the polishing plate 24 are relatively rotated while the polishing liquid is supplied in this way, and the coarse polishing of the wafer 30 is implemented for 5 minutes.

Following the implementation of coarse polishing, the cylinder is driven to lift the polishing head 40, and the polishing head support part 6 is rotated 90° to the right to move the polishing 40 to the second stage 4.

When the polishing head 40 is moved to the second stage 4, identical to the action of the first stage 3, the polishing head 40 is lowered to polish the wafer 30. The point of difference with the first stage 3 in terms of the processing conditions lies in the fact that the wafer pressurizing force and pressurizing force are taken as 2 g/mm$^2$ respectively, and a polishing time of 2 minutes is adopted.

Following the coarse polishing, the cylinder is driven to lift the polishing head 40 and the polishing head support part 6 is rotated 180° to the right to move the polishing head 40 to the load/unload stage 2.

In order to prevent the introduction of the abrasive grain for coarse polishing into the final polishing stage when the polishing head 40 is moved to the load/unload stage 2, the abrasive grain that attaches to the polishing head 11 in coarse polishing is washed for 10 seconds by distilled water or ozone water using a jet water flow jetted from a nozzle.

Following the completion of the washing of the polishing head 40, the polishing head support part 6 is rotated 90° to the left moving the polishing head 40 to the third stage 5.

Here, because of the low wafer pressurizing force in the final polishing step of low 1 g/mm$^2$, the immersion of the wafer 30 in the final abrasive cloth 26 is negligible. Accordingly, there is no generation of the problem of a concentration of elastic stresses from the final abrasive cloth 26 on the edge of the wafer 30 resulting in excessive polishing of the wafer peripheral part. In addition, because the actual polishing amount is small, there is no need for the use of a retainer ring 43. Thereupon, in the course of the movement to the third stage 5 the pressure within the air chamber 48 is released and the retainer ring 43 is caused to retract upward. The extent of this movement is designed to be 5 mm. This is to prevent the abrasive grain for coarse polishing attached to the retainer ring 43 from being introduced into the final polishing stage.

When the polishing head 40 is moved to the third stage 5 the electro-pneumatic regulator W is driven and compressed air of pressure greater than the air pressure is supplied to the air chamber 49 by way of the wafer pressurizing pipe 33 from the compressed air pump 58, and a state in which the air chuck 19 is pushed uniformly across its entirety at a pressure of 1 g/mm$^2$ by the air of the air chamber 49 is maintained. Thereafter, the polishing head 40 and polishing plate 24 are relatively rotated by the drive of polishing head rotating motor and polishing plate rotating motor, and the polishing liquid is supplied through the polishing liquid supply nozzle. In this state a cylinder not shown in the diagram is driven to lower the polishing head 40 until the wafer 30 contacts the final abrasive cloth 26. The wafer 30 is subjected to a uniform pressure of 1 g/mm$^2$ across its entire surface and pushed against the final abrasive cloth 26 for implementation of the final polishing of the target surface for polishing.

Because the bellows 46 are produced from Hastelloy and therefore expandable the wafer chuck 19 can be oscillated and centered to conform to the surface shape of the final abrasive cloth 26. Accordingly, the wafer 30 is constantly in parallel with the final abrasive cloth 26 and the wafer is pushed at a uniform pressure across its entirety by the final abrasive cloth 26.

Examples of the polishing liquid that can be employed for the final polishing include slurries composed of a mixture of an abrasive grain for final polishing of SiC or SiO or the like of diameter of the order of 5 to 500 nm and a water-based or oil-based liquid. In this way, the polishing head 40 and polishing plate 24 are relatively rotated while the polishing liquid is supplied, and the final polishing of the wafer 30 is implemented for 5 minutes.

Following the completion of the final polishing the cylinder is driven to lift the polishing head 40, the polishing head support part 6 is rotated 90° to the right, and the polishing head 40 is moved to the load/unload stage 2.

When the polishing head 40 is moved to the load/unload stage 2 a carry hand not shown in the diagram of the wafer carry device 8 is moved directly below the wafer chuck 19. Next, when the vacuum pump 56 is stopped, the adsorption force of the wafer chuck 19 is released and the wafer 30 adsorbed to the wafer chuck 19 is loaded on the carry hand. The steps for the polishing of the wafer 30 are completed in accordance with the above.

The polishing apparatus 1 of the abovementioned first and second embodiments shown in FIG. 1 facilitates a polishing of the wafer 30 in the stages 3 to 5 in parallel and, because the final polishing can be implemented at the third stage 5 while coarse polishing of the wafer 30 is being implemented at the first stage 3 and the second stage 4, the operating efficiency thereof is good.

In addition, although both the polishing head 40 and the polishing plate 24 of the polishing apparatus 1 are rotated to polish the wafer 30 for the purpose of preventing asymmetry of the wafer 30, polishing that is implemented on the basis of the rotation of one of these two is also possible.

Although, in the abovementioned first embodiment, a plate rubber and a plate spring are adopted as the material for the airbag 15 and, in the second embodiment, Hastelloy, which is a type of metal, is adopted as the material for the bellows 45, 46, the materials for employment are in no way restricted thereto and, provided they are elastically deformable by a flow pressure such as air pressure, plastics or other materials may be employed. It should be noted that a sheet that deforms elastically due to air pressure may be employed instead of the airbag 15.

In addition, there are no particular restrictions to the implementation of these embodiments with regard to the material of the wafer 30 and the size thereof and, apart from semiconductor wafers 30 of the numerical aperture currently manufactured such as silicon, GaAs, GaP and InP or the like, the present invention can have application in very large wafers 30 for which manufacture in the future is anticipated.

Embodiment 3

Figure 9:
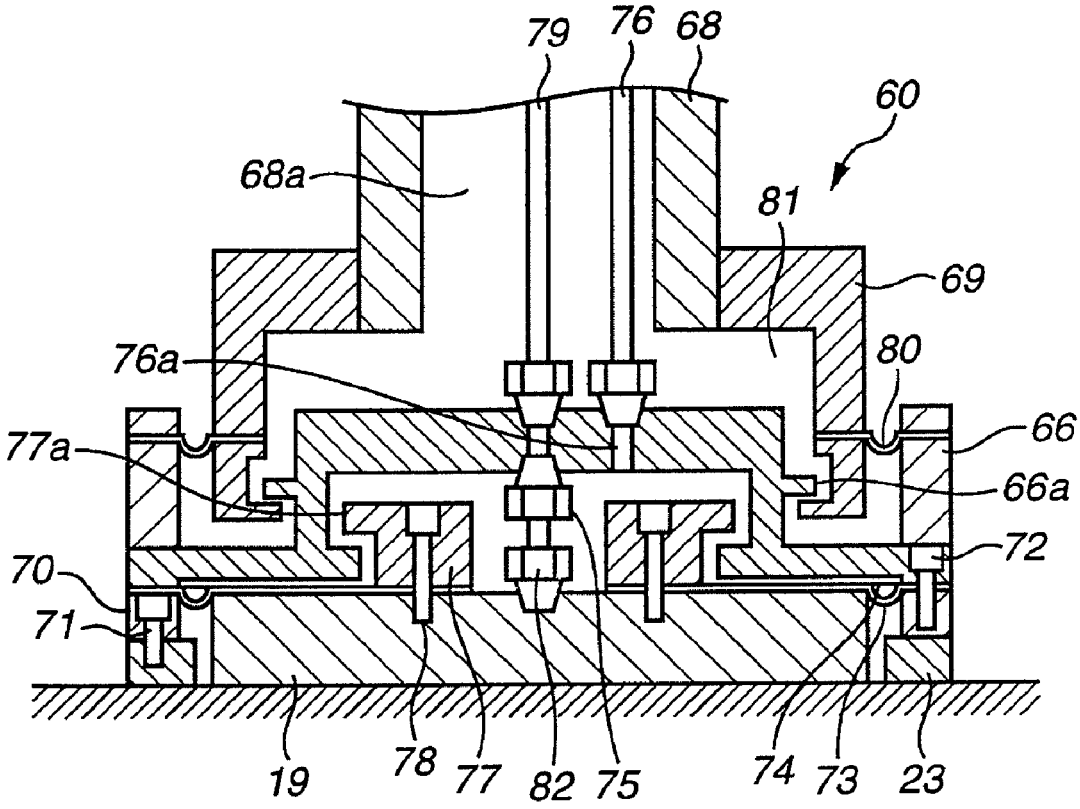
FIG. 9 is a vertical cross section illustrating the state in which the retainer ring of a dual series airbag type polishing head 60 pertaining to a third embodiment of the present invention has been lowered.
Figure 10:
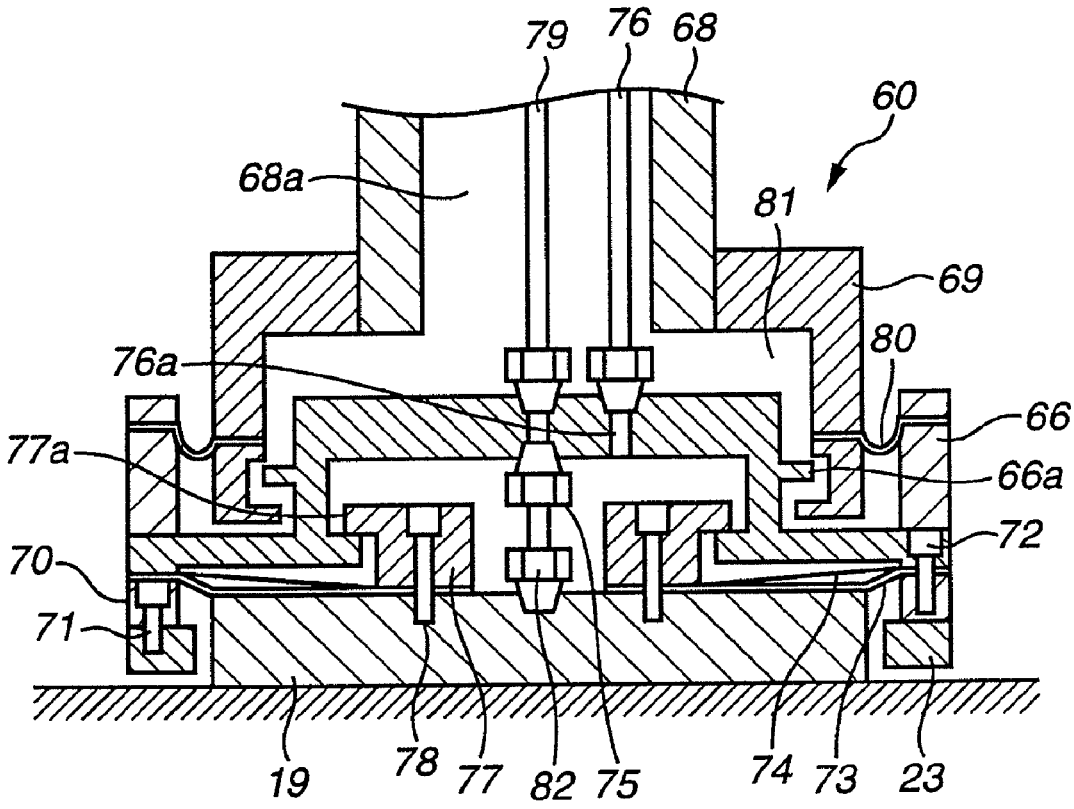
FIG. 10 is a vertical cross section illustrating the state in which the retainer ring of the dual series airbag type polishing head 60 pertaining to the third embodiment has been lifted.

Next, a description will be given of a third embodiment with reference to FIG. 9 and FIG. 10. FIG. 9 and FIG. 10 are vertical cross sections of a dual series airbag system polishing head 60 pertaining to a third embodiment of the present invention. FIG. 9 shows a state in which the retainer is lowered and FIG. 10 shows a state in which the retainer is lifted.

The dual series airbag system polishing head 60 comprises a shaft 68, frame 69, wafer chuck 19, retainer frame 66 and retainer ring 23 and the like. The symbol 68 in the diagram refers to a cylindrical hollow shaft, and a frame 69 is fixed to the periphery of the shaft 68.

A toroidal retainer-fixing piece 70 is fastened to the top of the retainer ring 23 by a bolt 71. The retainer-fixing piece 70 is further fastened to a retainer frame 66 by a bolt 72. A flexible plate spring 74 and plate rubber 73 are tensioned between the retainer-fixing piece 70 and the retainer frame 66, and a second airbag 75, formed as an airtight space, is formed by the retainer frame 66 and plate rubber 73. A wafer pressurizing pipe 76 is formed in the second airbag 75 passing through the shaft 68, and compressed air is supplied to the second airbag 75 through a supply port **76*a* of the wafer pressurizing pipe 76**.

The wafer chuck 19 is fixed to the center of the lower surface of the plate spring 74. The wafer chuck 19 which, by the screwing of a bolt 78 through the top of the plate rubber 73 by way of a plug piece 77, is fixed in a state in which the plate spring 74 and the plate rubber 73 tensioned in a plate shape are sandwiched between the plug piece 77 and the wafer chuck 19. A flange-like mechanical stopper **77*a* is provided in the periphery of the plug piece 77 which, when the wafer chuck 19 is lowered with respect to the retainer frame 66, latches with the retainer frame 66** to function as a stopper that indicates the stroke end.

An exhaust plug 82 is attached to the center of the upper part of the wafer chuck 19. The exhaust plug 82 is connected to an exhaust pipe 79 passing through a shaft 68, and pressure reduction within the wafer chuck 19 is implemented on the basis of exhaustion by way of the exhaust pipe 79. In the pressure-reduced state the wafer is vacuum-adsorbed to the adsorption surface that is formed on the lower surface of the wafer chuck 19.

A disc-shaped plate material 80 composed of a flexible material is tensioned between the retainer frame 66 and the frame 69. A first airbag 81 is formed in an airtight space enclosed by the frame 69, plate material 80 and retainer frame 66. Compressed air is supplied through a hollow hole **68*a* of the shaft 68 into the first airbag 81. A flange-like mechanical stopper 66*a*, which is provided in the retainer frame 66 in such a way as to latch to the frame 69, functions as a stopper to indicate the stroke end when the retainer frame 66 is lowered with respect to the frame 69**.

In this way, in the polishing head 60 of this embodiment, the first airbag 81 and second airbag 75 are arranged in series in a overlapped state.

Next, a description will be given of the operation of the polishing head 60 of this embodiment. When compressed air is supplied through the hollow hole **68*a* of the shaft 68 and a load P1 is applied to the first airbag 81, a load is applied to the retainer frame 66 and the wafer chuck 19 and the retainer ring 23 are integrally lowered. At this time, when a compressed air is supplied from the wafer pressurizing pipe 76 and a load P2 is applied to the second airbag 75, a load P2 is applied to the wafer chuck 19 and a load P3 (=P1−P2) is applied to the retainer ring 23**.

FIG. 10 illustrates the state in which the retainer ring 23 is lifted. Based on the dual series structure of this embodiment, the retainer ring 23 can be lifted by establishing the load P2 on the second airbag to be larger than the load P1 on the first airbag.

By way of example, when there is a desire to set the chuck load to 0.03 MPa and the retaining load to 0.03 MPa during coarse polishing, the load P1 on the first airbag 81 should be set to 0.043 MPa and the load P2 on the second airbag 75 should be set to 0.03 MPa. At this time, because the mechanical stopper **77*a* is not engaged to the retainer frame 66 as shown in FIG. 9, it does not function as a stopper and, in addition, with the exception of the plate member 80, plate spring 74 and the plate rubber 73, the plug piece 77, frame 69 and retainer frame 66 are arranged with a prescribed clearance there-between and the wafer chuck 19 and retainer ring 23** can be independently oscillated.

In addition, because the coarse polishing abrasive grain is not introduced into to the final polishing stage during final polishing, the polishing must be performed in a state in which the retainer ring is floating with respect to the final abrasive cloth. By way of example, when there is a desire in final polishing for the chuck load to be set to 0.015 MPa and the retaining load to be set to 0.00 MPa (floating state), the load P1 on the first airbag 81 should be set to 0.015 MPa and the load P2 on the second airbag 75 should be set to 0.020 MPa.

When a load P2 on the second airbag 75 is established that is larger than the load P1 on the first airbag 81, the wafer chuck 19, as is shown in FIG. 10, is lowered with respect to the retainer frame 66 until the stroke end. At this time, because the wafer chuck 19 is in a latched state with the retainer frame 66 by means of the mechanical stopper 77*a*, the pressurized force of the second airbag 75 is applied as an internal force and does not contribute to the chuck pressure. Because, as a result, only the load P1 of the first airbag 81 is applied on the wafer chuck 19, the chuck load can be easily controlled by the settability of the load P1.

Based on this embodiment, because the wafer chuck 19 and the retainer ring 23 can be independently oscillated using two airbags arranged in series, a worsening of the flatness of the wafer edge part and production of a wafer polished shape that is asymmetric can be prevented.

In addition, the outside diameter of the polishing head can be reduced by the arrangement of the retaining pressure mechanism and the chuck pressure mechanism in series. Because, as a result, the surface area across which the polishing apparatus is arranged can be reduced, the running costs can be lowered. Furthermore, because the polishing head can be compacted and weight-lightened, the time required for the replacement of a polishing head can be significantly shortened.

It should be noted that, although there is no mechanism provided in the polishing head 60 of FIG. 9 and FIG. 10 to independently rotate the retainer ring 23 with respect to the wafer chuck 19, a bearing mechanism may be provided between the retainer-fixing piece 70 and retainer ring 23 to independently rotate the retainer ring 23 and wafer chuck 19. In addition, the rotating mechanism of the polishing head 60 may be provided in the upper part of the shaft 68 to rotate everything below and including the shaft 68, or a mechanism may be adopted in which the shaft 68 does not rotate and the wafer chuck 19 rotates together with the retainer frame 69.

Embodiment 4

Figure 11:
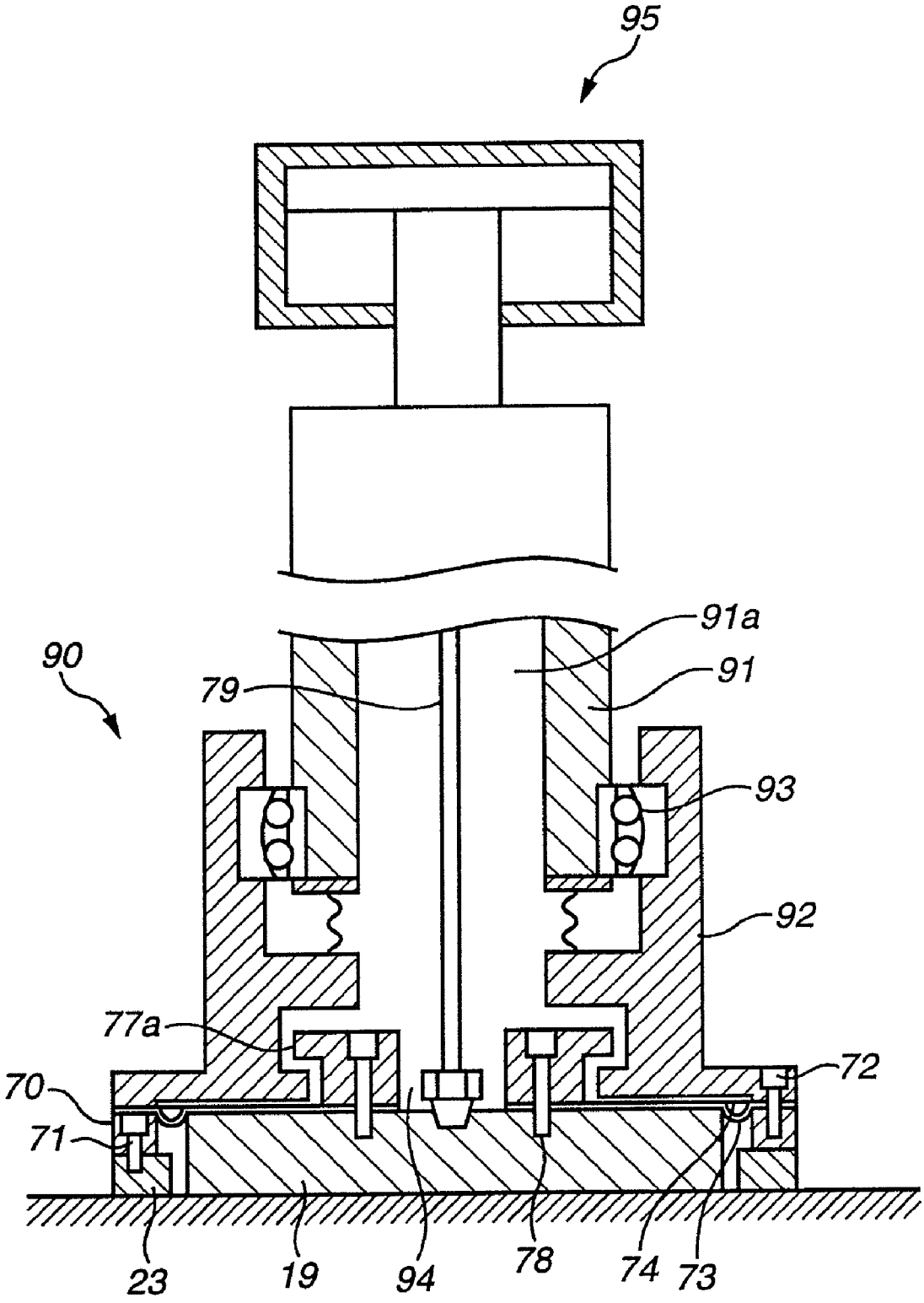
FIG. 11 is a partial vertical cross section showing in detail the retainer ring of an air cylinder+airbag type polishing head 90 pertaining to a fourth embodiment.
Figure 12:
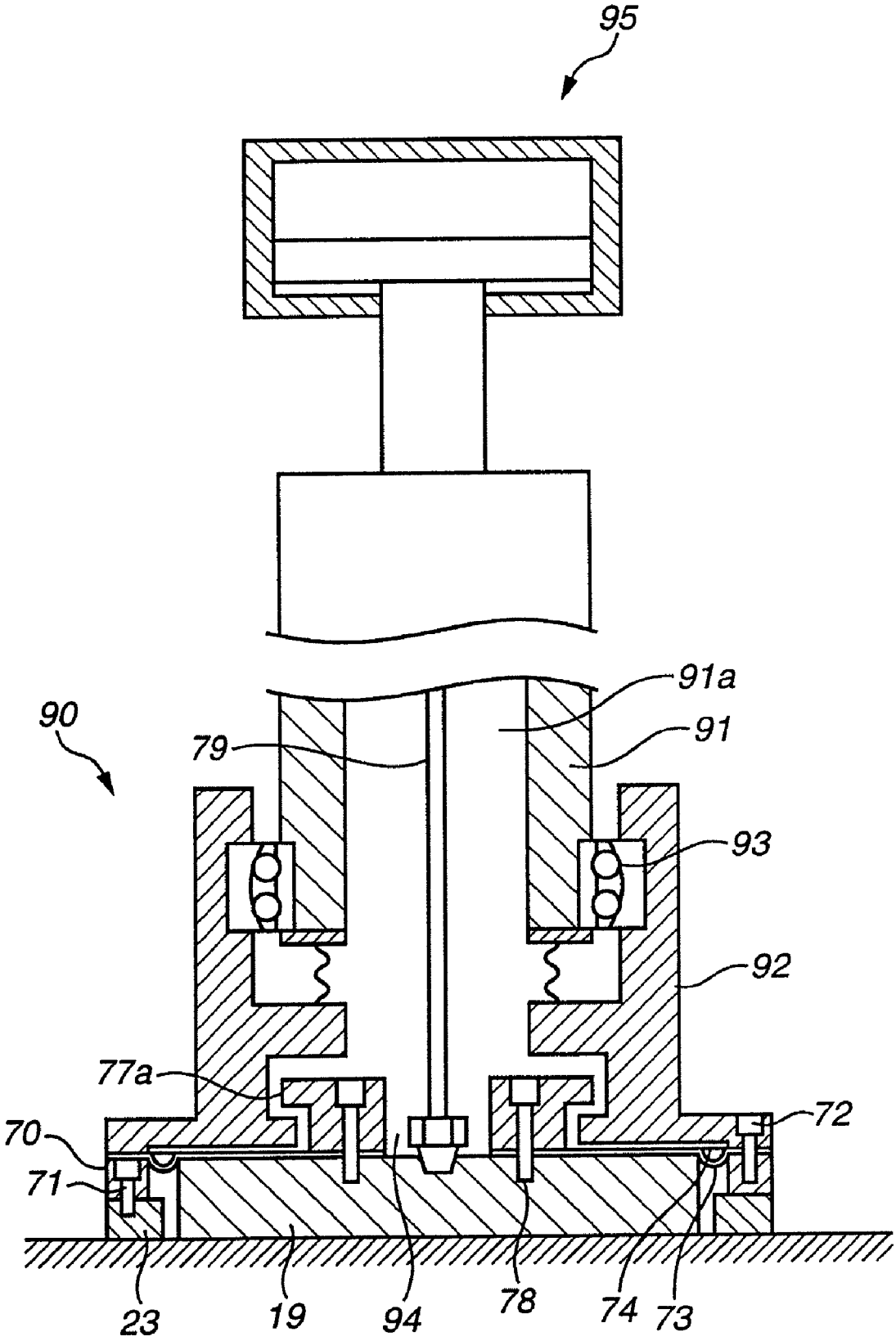
FIG. 12 is a partial vertical cross section showing the state in which the retainer ring of the air cylinder+airbag type polishing head 90 pertaining to the fourth embodiment has been lowered.
Figure 13:
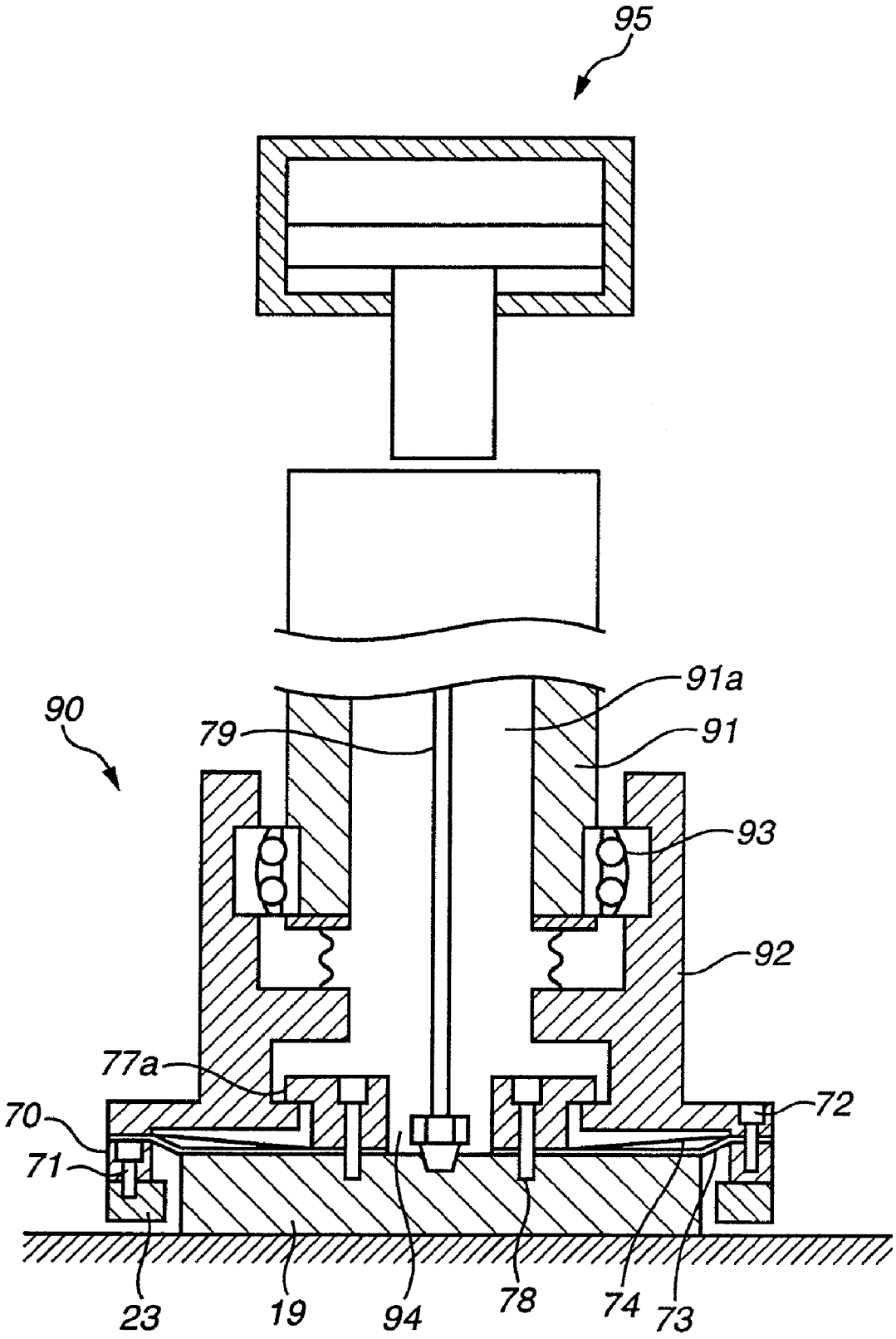
FIG. 13 is a partial vertical cross section showing a state in which the retainer ring of the air cylinder+airbag type polishing head 90 pertaining to the fourth embodiment has been lifted.

Next, a description will be given of a fourth embodiment with reference to FIGS. 11 to 13. FIGS. 11 to 13 are partial vertical cross sections of an air cylinder+airbag system polishing head 90 pertaining to a fourth embodiment of the present invention. FIG. 11 is a vertical cross section of the polishing head 90 in detail, FIG. 12 illustrates the state in which the retainer is lowered, and FIG. 13 illustrates the state in which the retainer is lifted.

The air cylinder+airbag system polishing head 90 of the present embodiment comprises a shaft 91, wafer chuck 19, retainer frame 92 and retainer ring 23 and so on. The symbol 91 in the diagram refers to a hollow cylindrical shaft, and a retainer frame 92 is provided on the periphery of the shaft 91.

The inner circumferential surface of a spherical-surface bearing 93 is fixed to the outer circumferential surface of the shaft 91, and the retainer frame 92 is fixed to the outer circumferential surface of the spherical-surface bearing 93. The shaft 91 and the retainer frame 92 are coupled in such a way as to be able to oscillate smoothly by means of the spherical-surface bearing 93.

A toroidal retainer-fixing piece 70 is fastened to the top of the retainer ring 23 by a bolt 71. The retainer-fixing piece 70 is further fastened to the retainer frame 92 by a bolt 72. A flexible plate spring 74 and plate rubber 73 are tensioned between the retainer-fixing piece 70 and the retainer frame 92, and an airbag 94, formed as an airtight space, is formed by the retainer frame 92 and plate rubber 73. Compressed air is supplied to the airbag 94 through a supply port 91*a* of the shaft 91.

The wafer chuck 19 is fixed to the center of the lower surface of the plate spring 74. By the screwing of a bolt 78 through the top of the plate rubber 73 by way of a plug piece 77, the wafer chuck 19 is fixed in a state in which the plate spring 74 and the plate rubber 73 tensioned in a plate shape are sandwiched between the plug piece 77 and the wafer chuck 19. A flange-like mechanical stopper 77*a* is provided in the periphery of the plug piece 77 which, when the wafer chuck 19 is lowered with respect to the retainer frame 92, latches with the retainer frame 92 to function as a stopper to indicate the stroke end.

It should be noted that, with the exception of the plate spring 74 and the plate rubber 73, the plug piece 77 and retainer frame 92 are arranged with a prescribed clearance there-between and the wafer chuck 19 and retainer frame 92 can be oscillated independently.

An exhaust pipe 79 is connected to the plug piece 77 passing though the shaft 91, and pressure reduction of the wafer chuck 19 is implemented by exhaustion by way of the exhaust pipe 79. In the pressure-reduced state the wafer is vacuum-adsorbed to the adsorption surface formed on the lower surface of the wafer chuck 19.

The shaft 91 is further linked to a cylinder 95 at the upper part thereof. Cylinders that can be employed as the cylinder 95 include a fluid cylinder or liquid cylinder such as an hydraulic cylinder, and a gas cylinder such as an air cylinder. The shaft 91 is vertically moved together with the retainer frame 92 and the wafer chuck 19 by the action of the cylinder 95.

In this way, in the polishing head 90 of this embodiment, the airbag 94 and cylinder 95 are arranged in series in a overlapped state.

Next, a description will be given of the operation of the polishing head 90 of this embodiment with reference to FIG. 12 and FIG. 13. As shown in FIG. 12, when a load P1 is applied to the shaft 91 by the cylinder 95, a load is applied to the retainer frame 92 and the wafer chuck 19 and the retainer ring 23 are integrally lowered. At this time, when compressed air is supplied through a hollow hole 91*a* of the shaft 91 shown in FIG. 11 and a load P2 is applied to the airbag 94, a load P2 is applied to the wafer chuck 19 and a load P3 (=P1−P2) is applied to the retainer ring 23.

FIG. 13 illustrates the state in which the retainer ring 23 is lifted. Based on the air cylinder+airbag system of this embodiment, the retainer ring 23 can be lifted by establishing the load P2 on the second airbag 94 to be larger than the load P1 of the cylinder 95.

When the load P2 on the airbag 94 is larger than the load P1 of the cylinder 95, as is shown in FIG. 13 the wafer chuck 19 is lowered with respect to the retainer frame 92 until the stroke end. At this time, because the wafer chuck 19 is in a linked state with the retainer frame 92 by means of the mechanical stopper 77*a*, the pressure force of the airbag 94 is applied as an internal force and does not contribute to the chuck pressure. Because, as a result, only the load PI of the cylinder 95 is applied to the wafer chuck 19, the chuck load can be easily controlled by the settability of the load P1.

Based on this embodiment, because the wafer chuck 19 and the retainer ring 23 are independently oscillated by a retainer frame 92 that is oscillatably connected to the shaft 91 and a wafer chuck 19 is oscillatably provided with respect to the retainer frame 92, a worsening of the flatness of the wafer edge part and production of a wafer polished shape that is asymmetric can be prevented.

In addition, the outside periphery of the polishing head can be reduced by the arrangement of the retaining pressure mechanism and the chuck pressure mechanism in series. Because, as a result, the surface area across which the polishing apparatus is arranged can be reduced, the running costs can be lowered. Furthermore, because the polishing head can be compacted and weight-lightened, the time required for the replacement of a polishing head can be significantly shortened.

It should be noted that, although there is no mechanism provided in the polishing head 90 of FIGS. 11 to 13 to independently rotate the retainer ring 23 with respect to the wafer chuck 19, a bearing mechanism may be provided between the retainer-fixing piece 70 and retainer ring 23 to independently rotate the retainer ring 23 and wafer chuck 19. In addition, the rotating mechanism of the polishing head 90 may be provided in the upper part of the shaft 91 to rotate everything below and including the shaft 91, or a mechanism may be adopted in which the shaft 91 does not rotate and the wafer chuck 19 rotates together with the frame 92.

Although the description given in the first to fourth embodiments described above pertains to the employment of a toroidal retainer ring, the retainer ring is not restricted thereto and it may be provided as a plurality of blocks fixed in a toroidal shape around the retainer frame. In addition, the lower surface of the retainer ring may be flat, or it may comprise a plurality of grooves.

In addition, in the first to fourth embodiments described above, without the implementation of the retraction of the retainer ring in the final polishing step, the pressurizing force may be established as a pressurizing force that is smaller than the pressurizing force of the coarse polishing step, by way of example, as a force of the same order as the wafer pressurizing force. If the pressurizing forces are established in this way the final polishing step can be implemented without worsening of the wafer flatness produced in the coarse polishing step.

That is to say, in the final polishing step of the present invention, the retainer ring may either be retracted or a weakened retainer ring pressurizing force may be used.

Accordingly, the invention of this application is not restricted to the embodiments described above and, within a range that is not beyond the gist of the invention, a range of applications and modifications can be made to, for example, the method for supporting the retainer ring and the wafer chuck, the method for the polishing the wafer, and the polishing target material.

[Working Data]

A specific description is given below, with reference to FIGS. 6A to 6C, of the results of the polishing of a wafer employing the wafer polishing apparatus of the prior art that does not comprise a retainer ring, and the polishing of a wafer employing the wafer polishing apparatus of the invention of this application.

A sub-flatness SFQR, which is used as a standard for comparison of the flatness of wafers, was employed. The SFQR was found by the sampling of a plurality of square shapes of prescribed dimensions from the wafer, the finding of the difference between the samples and the desired wafer thickness, and the calculating of the average value of these samples.

Figure 6A:
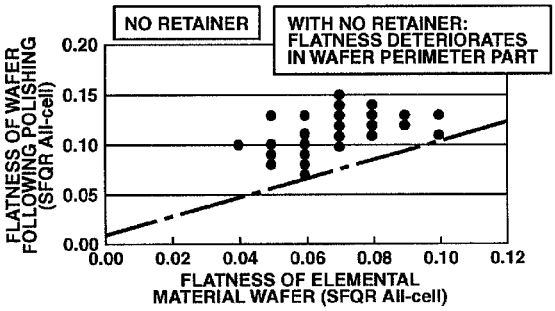
FIG. 6A is a graph in which, for a wafer polished using a wafer polishing apparatus not comprising a retainer ring of the prior art, the SFQR of the elemental material wafer prior to polishing is expressed on the horizontal axis and the SFQR of the wafer following polishing is expressed on the vertical axis.

In FIG. 6A, which shows the results of the polishing of a wafer using the wafer polishing apparatus of the prior art that does not comprise a retainer ring, the SFQR of the elemental material wafer prior to polishing is expressed on the horizontal axis and the SFQR of the wafer following polishing is expressed on the vertical axis. As is clear from the graph, the flatness of the wafer following polishing is worse than the flatness of the elemental material wafer. This is because, as there is no retainer ring provided, a deterioration of the flatness of the peripheral part occurs.

Figure 6B:
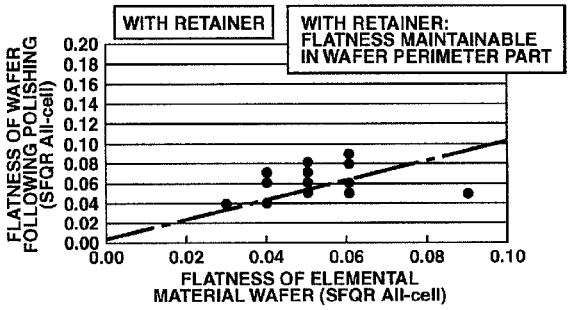
FIG. 6B is a graph in which, for a wafer polished using a wafer polishing apparatus pertaining to the invention of this application, the SFQR of the elemental material wafer prior to polishing is expressed on the horizontal axis and the SFQR of the wafer following polishing is expressed on the vertical axis.

In contrast thereto, FIG. 6B shows the results of the polishing of a wafer employing the wafer polishing apparatus pertaining to the present invention in which the SFQR of the elemental material wafer prior to polishing is expressed on the horizontal axis and the SFQR of the wafer following polishing is expressed on the vertical axis. As is clear from the graph, the flatness of the elemental material wafer following polishing is maintained. This is because, due to the provision of a retainer ring, the flatness of the peripheral part of the wafer can be maintained.

Figure 6C:
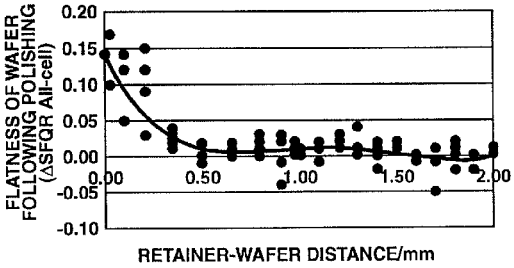
FIG. 6C is a graph in which the distance between the retainer ring and the wafer in the wafer polishing apparatus pertaining to the invention of this application is expressed on the horizontal axis, and the SFQR of the wafer following polishing is expressed on the vertical axis.
Figure 7:
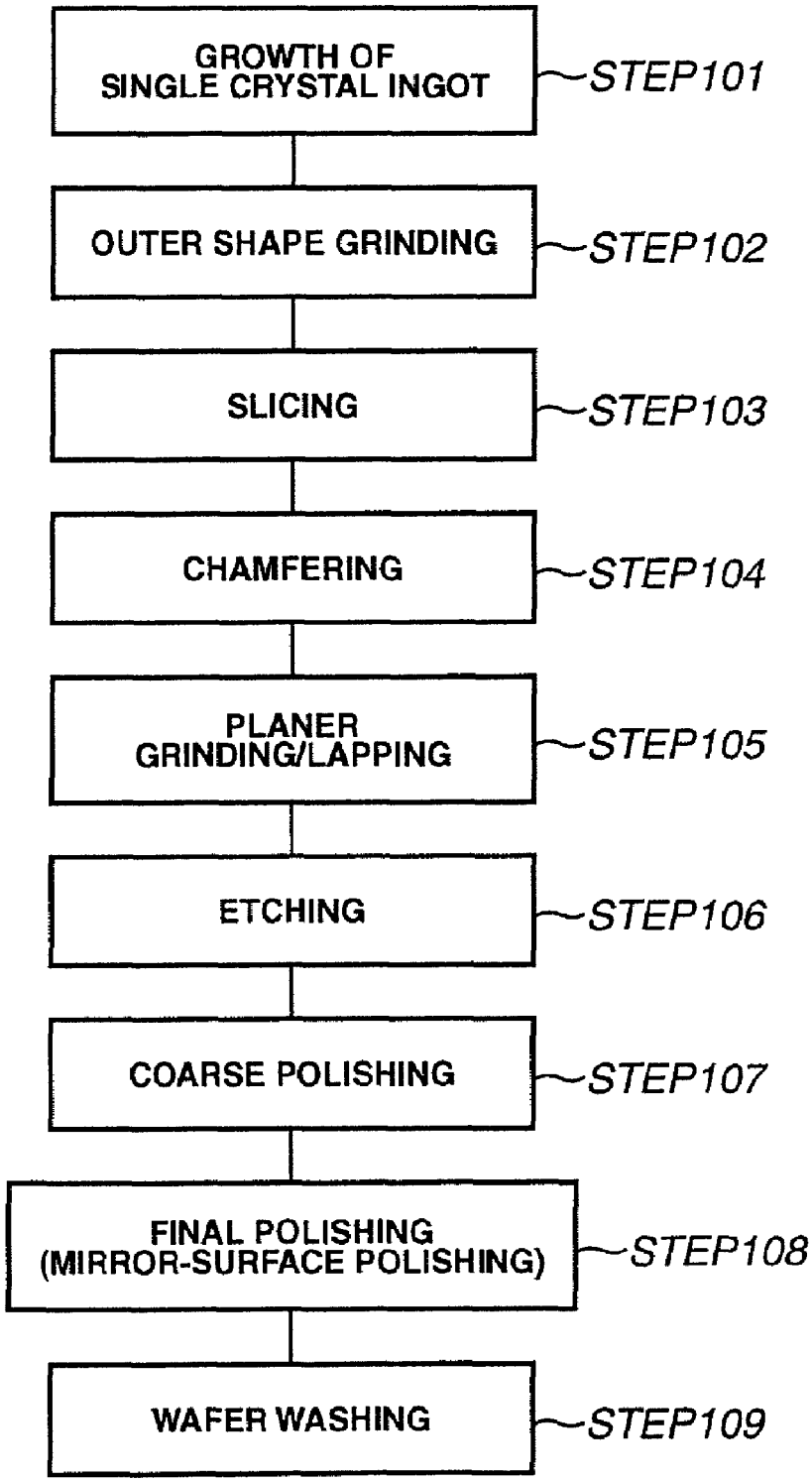
FIG. 7 is a flow diagram summarizing the method for the manufacture of a semiconductor wafer.
Figure 8:
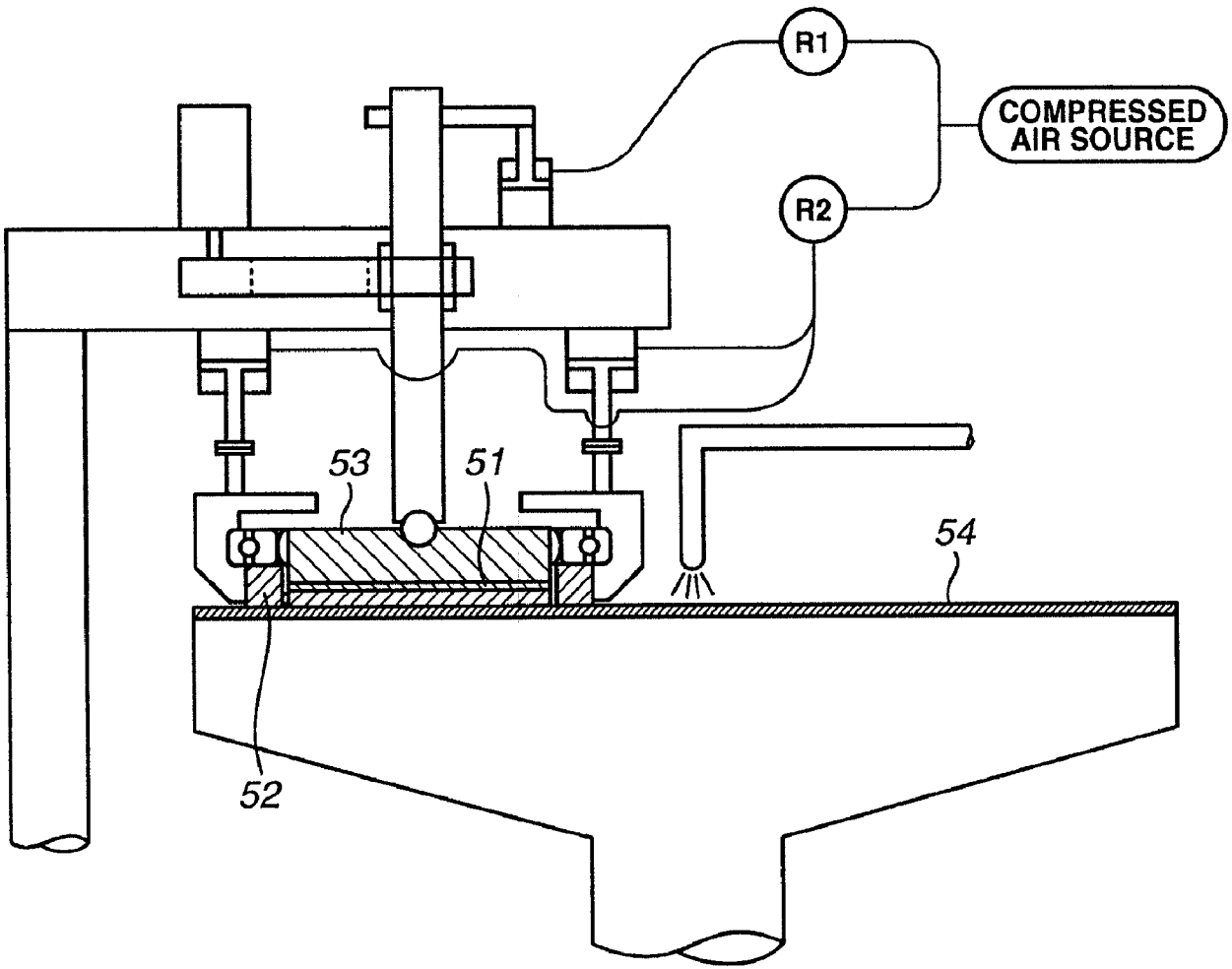
FIG. 8 is a schematic view illustrating one example of the wafer polishing apparatus of the prior art.

On the other hand, in FIG. 6C, the distance between the retainer ring and the wafer of the wafer polishing apparatus pertaining to the invention of this application is expressed on the horizontal axis and the SFQR of the wafer following polishing is expressed on the vertical axis. It is clear from this graph that the optimum distance between the retainer ring and the wafer is between 0.5 mm and 2.0 mm.

As is described above, based on the wafer polishing apparatus of the present invention, by virtue of the fact that the wafer chuck and the retainer ring can be independently pressurized to respectively optimum pressures, the flatness of the wafer edge part in the coarse polishing for engendering flatness can be improved.

In addition, based on the wafer polishing apparatus of the present invention, because the retainer ring is retracted from the polishing surface in final polishing, contamination of the final stage as a result of the introduction of the coarse polishing abrasive grain can be prevented. Accordingly, because the final polishing step and the coarse polishing step can be continuously implemented using the same polishing head, a reduction in apparatus costs can be achieved.

Furthermore, in a first embodiment of the invention of this application, by virtue of the fact that the retracting mechanism of the retainer ring can be actualized mechanically by the use of springs or the like, even when the retaining pressurizing pipe is disconnected the retainer ring can be moved to the retracted position to prevent contamination of the final polishing stage.

In addition, although deterioration of the wafer edge part and production of a polished wafer of an asymmetric shape occurs using the wafer polishing apparatus of the prior art because the retainer ring cannot be oscillated, these problems do not arise with the wafer polishing apparatus of the present invention because the wafer chuck and the retainer ring are independently oscillated.

Furthermore, based on the wafer polishing apparatus of the present invention, the deterioration in wafer flatness that has its origins in the precision processing of the retaining member can be prevented by the relative rotation of the wafer chuck and the retainer ring.

In addition, based on the wafer polishing apparatus of the present invention, the processing in the final polishing step and the coarse polishing step of a sheet polishing apparatus can be implemented using a common polishing head, and the time required for the polishing steps can be markedly lowered.

In addition, based on the wafer polishing apparatus of the present invention, the wafer affixed to the wafer chuck at a prescribed position precision does not contact the retainer ring during oscillation and mechanical damage to the wafer edge can be avoided.

INDUSTRIAL APPLICABILITY

The present invention can be utilized in the field of mirror-surface polishing in which the surface of semiconductor wafers and liquid crystal substrates and so on are flattened.

The invention claimed is:

1. A method of wafer polishing comprising a coarse polishing step and a final polishing step, in which, a polishing liquid is interposed between a polishing target material and an abrasive cloth while the polishing target material held by a chuck is pushed against the abrasive cloth, polishing of the polishing target material is implemented by the abrasive cloth by a relative motion of the chuck and a polishing plate, wherein a retainer ring is vertically movable in a periphery of the chuck, and a pushing force of the retainer ring against the abrasive cloth is set in accordance with the polishing step, the polishing in a coarse polishing step is implemented when the abrasive cloth is pushed by the retainer ring, the retainer ring is retracted upward during transition from the coarse polishing step to a final polishing step, and the polishing in a final polishing step is implemented when the retainer ring is retracted form the abrasive cloth.

2. The method of wafer polishing according to claim 1, characterized in that the coarse polishing step and the final polishing step implemented in series by moving a polishing head comprising the chuck and the retaining ring from a stage of the coarse polishing step to a stage of the final polishing step, and the retaining ring is retracted upward during the movement from the stage of the coarse polishing step to the stage of the final polishing step.

3. The method of wafer polishing according to claim 1, characterized in that the coarse polishing step and the final polishing step are implemented in series by moving the polishing head comprising the chuck and the retaining ring from the stage of the coarse polishing step to the stage of the final polishing step through a stage of washing, and a polishing target surface of a polishing target material held by the chuck of the polishing head and an abrasive grain of polishing liquid attached to the retaining ring are washed in the stage of washing.

* * * * *

UNITED STATES PATENT AND TRADEMARK OFFICE

CERTIFICATE OF CORRECTION

PATENT NO. : 7,654,883 B2
APPLICATION NO. : 12/371320
DATED : February 2, 2010
INVENTOR(S) : Kitahashi et al.

It is certified that error appears in the above-identified patent and that said Letters Patent is hereby corrected as shown below:

Title Page; On the Cover Sheet in "(75) inventors"
Please delete "Tamoaki Tajiri" and insert --Tomoaki Tajiri--.

Signed and Sealed this

Fourth Day of May, 2010

David J. Kappos

David J. Kappos
*Director of the United States Patent and Trademark Office*